US007266337B2

(12) United States Patent
Nakamura et al.

(10) Patent No.: US 7,266,337 B2
(45) Date of Patent: Sep. 4, 2007

(54) FIXING ROLLER, AND METHOD OF PRODUCING THE SAME, FIXING DEVICE AND IMAGE FORMING DEVICE

(75) Inventors: Michinori Nakamura, Tokyo (JP); Naruhiko Ito, Tokyo (JP); Kazuaki Teshima, Tokyo (JP); Kazuhiro Murakami, Tokyo (JP); Kazuki Yokokawa, Tokyo (JP); Takeshi Inoue, Tokyo (JP); Naoki Kiyohara, Tokyo (JP); Kazuaki Imaizumi, Tokyo (JP); Yasushi Sawada, Tokyo (JP); Hiroshi Ogawa, Tokyo (JP); Hidekatsu Wada, Tokyo (JP); Tomoaki Chiba, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 218 days.

(21) Appl. No.: 10/499,749

(22) PCT Filed: Jun. 18, 2004

(86) PCT No.: PCT/JP2002/013282

§ 371 (c)(1),
(2), (4) Date: Oct. 22, 2004

(87) PCT Pub. No.: WO03/054635

PCT Pub. Date: Jul. 3, 2003

(65) Prior Publication Data

US 2005/0180789 A1 Aug. 18, 2005

(30) Foreign Application Priority Data

| | | |
|---|---|---|
| Dec. 20, 2001 | (JP) | 2001-387975 |
| Mar. 27, 2002 | (JP) | 2002-087786 |
| Apr. 30, 2002 | (JP) | 2002-128004 |
| May 10, 2002 | (JP) | 2002-135465 |
| Jun. 28, 2002 | (JP) | 2002-189050 |

(51) Int. Cl.
*G03G 15/20* (2006.01)

(52) U.S. Cl. ..... 399/330

(58) Field of Classification Search ..... 399/320–323, 399/328–339

See application file for complete search history.

(56) References Cited

FOREIGN PATENT DOCUMENTS

| | | | |
|---|---|---|---|
| JP | 63-27872 | | 2/1988 |
| JP | 6-130855 | | 5/1994 |
| JP | 8-171299 | | 7/1996 |
| JP | 8-248798 | | 9/1996 |
| JP | 9-258594 | | 10/1997 |
| JP | 10-116675 | | 5/1998 |
| JP | 2000-29342 | | 1/2000 |
| JP | 2001175120 A | * | 6/2001 |
| JP | 2002072750 A | * | 3/2002 |

OTHER PUBLICATIONS

Translation of Nishikawa (JP10-116675).*

Abstract of Nishikawa JP 10-116675 (inadvertently omitted from Office Action mailed Dec. 6, 2006).*

* cited by examiner

*Primary Examiner*—David M. Gray
*Assistant Examiner*—Ryan Gleitz
(74) *Attorney, Agent, or Firm*—patenttm.us; James H. Walters

(57) ABSTRACT

A coil spring 60 is provided in an empty room (inside of a fixing roller 50) of a main body 52 of a roller. The coil spring 60 is in contact with an inside wall 52*a* surrounding the empty room of the roller main body 52 and pushes the inside wall 52*a* outward. The coil spring 60 and the inside wall face 52*a* are coated with a black film 66 except the contact portion 62 of the coil spring 60 and the inside wall 52*a*.

16 Claims, 29 Drawing Sheets

FIXING ROLLER, AND METHOD OF PRODUCING THE SAME, FIXING DEVICE AND IMAGE FORMING DEVICE

TECHNICAL FIELD

The present invention relates to a fixing roller which delivers a recording medium by aid of a pressing roller for image fixation, a method of manufacturing the fixing roller, a fixation assembly, and an image forming apparatus.

BACKGROUND TECHNIQUES

As output apparatuses of computers and workstations, electrophotography type of image-forming apparatuses are known which form images on a recording medium by use of a developing agent (toner). With the electrophotographic image-forming apparatus, for example, an electrostatic latent image is formed by projecting a light beam (e.g., laser beam) carrying image information onto an image holding member such as a photosensitive drum; a toner is supplied onto the electrostatic latent image by a developing roller to form a developed image; the developed image is transferred by a transferring roller onto a recording medium to form a transferred image (developed image); and the recording medium having received the transferred image is delivered to a fixing assembly to fix the transferred image on the recording medium.

The fixation assembly generally comprises a fixing roller having a built-in heater and a pressing roller in pressure contact with the fixing roller. For fixation of the transferred image on the recording medium, the fixing roller and a pressing roller pinch and deliver the recording medium to heat the recording medium to a prescribed fixation temperature and simultaneously press it. The transferred image is fixed by heat and pressure. The recording medium holding the fixed image is taken out of the fixation assembly by discharge rollers.

The fixation assembly is explained by reference to FIG. 29.

FIG. 29 is a diagram illustrating schematically a conventional fixation assembly.

The fixation assembly 100 visualizes permanently the toner (image) 102 on a recording medium 104. The recording medium 104 delivered in the arrow-A direction by a delivery unit (not shown in the drawing) is guided by fixation inlet guide 106 and is introduced to a nip 108 between a fixing roller 120 and a pressing roller 130.

The fixing roller 120 heats and melts the toner. A thermistor 140 is in contact with the peripheral face (surface) of the fixation roller 120 to monitor the temperature of the peripheral face of the fixation roller 120. The fixation roller 120 has a built-in heat source (heater) like a halogen heater 122. The halogen heater 122 is controlled at a prescribed fixation temperature by a controller (not shown in the drawing) by reference to the peripheral surface temperature measured by the thermistor 140 to keep the outside peripheral temperature of the fixing roller 120 at a prescribed level.

Generally the fixation roller 120 is constituted for example, of a core metal 124 made of an iron or aluminum pipe-shaped member coated with a releasable fluoro-resin layer 126. The fixing roller 120 is rotated in the arrow-B direction by a driving source (not shown in the drawing).

The pressing roller 130 presses the recording medium 104 at a prescribed pressure against the fixation roller 120. The pressing roller 130 is constituted, for example, of a core metal 132 coated with an elastic material layer 134 such a layer of silicone rubber and fluro-rubber in a prescribed thickness the peripheral face thereof. The pressing roller 130 is pressed against the fixation roller 120 at a prescribed pressure and is rotated in the arrow C direction to apply pressure for fixation of the toner 102 onto the recording medium 104.

When the recording medium 104 has entered the nip 108, the toner 102 on the recording medium 104 is fused at the aforementioned fixation temperature, and the fused toner 102 is pressed against the recording medium 104 with the aforementioned load and is fixed on the recording medium 104. The recording medium 104 carrying the toner 102 fixed thereon is released from the fixing roller 120 and the pressuring roller 130 by a releasing nail 142 to reach a sheet-discharging roller (not shown in the drawing) and is discharged out of the apparatus.

A fixing roller 120, which is manufactured by working of an aluminum pipe, for example, is made to have a smaller outside diameter by about 0.07-0.2 mm at the lengthwise middle portion of the fixing roller 120 than the outside diameter at the both end portions of the fixation roller 120 (so-called inverse crown shape). The larger diameter at the both lengthwise ends of the fixing roller 120 than the lengthwise middle portion thereof makes larger the peripheral speed of the fixing roller 120 at the both lengthwise end portions to deliver the recording medium 104 by pulling it outward (so-called inverse crown effect). Consequently, the recording medium 104 can be delivered without wrinkling.

The warming-up time of the fixing roller 120 is preferably shorter in view of energy saving. A certain image-forming apparatus is capable of finishing and discharging a first copy sheet within 30 seconds (warming-up time) after turning on the main switch from a complete cool state of the image-forming apparatus main body. The warming-up time is becoming shorter year by year.

In a standby state in which the main switch of the image-forming apparatus is kept turned on, the power consumption for keeping the fixing assembly in a warm state is desirably less. For decreasing the power consumption during the standby state, preferably the heater of the fixing assembly is turned off completely. In the case where the heater of the fixation assembly is turned off completely, for heating the fixing roller immediately up to the prescribed temperature, the wall thickness of the fixing roller is made thinner to decrease the heat capacity thereof. Therefore, the fixation roller is usually made of aluminum alloy having a high thermal conductivity.

In order to shorten the warming-up time, recently the wall thickness of the fixing roller 120 is decreased to as thin as 0.8 mm. With a smaller wall thickness of the fixing roller 120, the fixing roller may be deformed in fixation of the image by heat and pressure by holding the recording medium 104 between the fixing roller 120 and the pressing roller 130 (at the nip 108). With the fixing roller 120 having a smaller cylinder diameter at the lengthwise middle portion than at the lengthwise ends, the middle portion is liable to be deformed to lower the fixation performance at this lengthwise middle portion.

To solve the above problems, insertion of a spring coil into the interior of the fixing roller 120 is disclosed to reinforce the fixing roller 120 (Japanese Patent Application Laid-Open No. 10-116675). In another technique, a rib is formed in a spiral state on the inside peripheral wall of the fixing roller 120 to reinforce the fixing roller 120 (Japanese Patent Application Laid-Open No. 2000-29342)

However, the fixing roller having a spiral spring or spiral rib on the inside peripheral face has locally a higher strength at the portion opposite to the inside spiral portion. As the results, the outside peripheral portion corresponding to the inside spiral member will give a higher nip pressure than other portions to decrease the inverse crown effect. Moreover since the portion of the higher nip pressure is spiral, the recording medium is allowed to deviate toward one lengthwise end side of the fixing roller. Thereby the recording medium may come to be fed obliquely or may be wrinkled to cause failure in delivery of the recording medium and to make instable the fixation of the transferred image on the recording medium.

DISCLOSURE OF THE INVENTION

The present invention intends to provide a fixing roller which can be warmed up in a shorter time and achieving stable fixation performance, and also to provide a process for producing the fixing roller, and a fixation assembly and an image-forming apparatus employing the fixing roller.

For achieving the above objects, a first fixing roller of the present invention is a fixing roller of a fixation assembly for fixing a developed image transferred onto a recording medium by application of heat and pressure on the recording medium, the fixing roller delivering the recording medium by holding the recording medium with a pressing roller, and having an empty room and a heater in the empty room, being characterized in that (1) the fixing roller comprises a reinforcing member for pushing by contact outward an inside wall face surrounding the empty room, and (2) a non-contact area of the reinforcing member and the inside wall face excluding the contact portion between the reinforcing member and the inside wall face is coated with a black film.

(3) The black film may be a heat-resistant film.

(4) The reinforcing member and the non-contact area may be coated with the black film by applying and baking the black paint.

For achieving the above object, a process of the present invention for producing a fixing roller of a fixation assembly for fixing a developed image transferred onto a recording medium by application of heat and pressure on the recording medium, the fixing roller delivering the recording medium by holding the recording with a pressing roller, and having an empty room and a heater in the empty room, characterized in that the process comprises (5) a step of inserting a reinforcing member into the empty room so as to be in contact with an inside wall face surrounding the empty room and to push the inside wall outward, (6) a step of coating a non-contact area of the reinforcing member and the inside wall face excluding the contact portion between the reinforcing member and the inside wall face.

(7) The reinforcing member may be inserted into the empty room, and then (8) the black paint is applied and baked on the non-contact area.

A first fixation assembly of the present invention for achieving the above objects (9) is provided with any of the fixation rollers set forth above, and

(10) transfers a developed image onto a recording medium by pressing a pressing roller against the said fixing roller.

A second fixing roller of the present invention for achieving the above objects comprises

(11) a cylindrical roller having an empty room;

(12) a coiled wire extending in the empty room of the cylindrical roller in the length direction of the cylindrical roller, being in contact with an internal peripheral face of the cylindrical roller, and fastened at a first end thereof to a first lengthwise end of the cylindrical roller; and

(13) a gear fastened to a second lengthwise end of the cylindrical roller and fixed to a second end of the wire; and

(14) the cylindrical roller is rotated by driving the gear in a direction of enlarging the coil diameter of the coiled wire.

(15) The first end of the coiled wire is inserted into a hole formed at the first lengthwise end of the cylindrical roller to be fastened detachably.

(16) The driving force of the gear is transmitted directly to the second lengthwise end of the cylindrical roller, and

(17) the directly transmitted driving force may be weaker than the driving force transmitted from the gear directly to the second end of the coiled wire.

(18) A recess may be formed at the second lengthwise end thereof, and

(19) the gear may have a projection to be fit into the recess.

(20) The coiled wire may serve to pull the gear toward the first lengthwise end of the cylindrical roller.

A third fixing roller of the present invention for achieving the above object comprises

(21) a cylindrical roller having an empty room;

(22) a coiled wire extending in the empty room in the length direction of the cylindrical roller, being in contact with an inside peripheral face of the cylindrical roller to push the inside wall face outward; and

(23) a gear fixed to the end of the wire at second lengthwise end of the cylindrical roller so as to be pulled toward the first lengthwise end of the cylindrical roller.

(24) The cylindrical roller may have a recess at the second lengthwise end thereof,

(25) the gear may have a projection to be engaged to the recess, and a hole for inserting the end of the wire, and

(26) the wire may serve to pull the gear toward the first end of the cylindrical roller by fastening by inserting the end thereof into the hole of the gear.

A fourth fixing roller of the present invention for achieving the above object comprises:

(27) a cylindrical roller having an empty room, and

(28) a coiled wire extending in the empty room in the length direction of the cylindrical roller and being in contact with an internal peripheral face of the cylindrical roller to push the inside wall face outward; and

(29) the direction of coiling of the wire is reversed at a prescribed position in the lengthwise length direction of the cylindrical roller.

(30) The direction of winding of the wire may be reversed at a lengthwise middle position of the cylindrical roller.

(31) The upstream portions of the coiled wire in the rotation direction of the cylindrical roller may be nearer to the lengthwise middle position of the cylindrical roller than the downstream portions of the coiled wire in the rotation direction adjacent to the upstream portion.

(32) The coiled wire in contact with the inside peripheral face of the cylindrical roller to press the inside peripheral face outward may be constituted of plural fractions of the coiled wire shorter than the cylindrical roller and are linked together.

(33) The wire may be constituted of an elastic material.

A fifth fixing roller of the present invention for achieving the above object comprises:

(34) a cylindrical roller having an empty room; and

(35) a coiled wire constituted of combination of two wire fractions each shorter than the cylindrical roller extending in the empty room in the length direction of the cylindrical roller and being in contact with an inside peripheral face of the cylindrical roller to push the inside wall face outward; and

(36) the directions of the coiling of the two coiled wires are reversed.

(37) Upstream portions of the coiled wire fractions in the rotation direction of the cylindrical roller are nearer to a lengthwise middle position of the cylindrical roller than the downstream portions of the coiled wire fractions in the rotation direction adjacent to the upstream portion.

A sixth fixing roller of the present invention for achieving the above objects comprises

(38) a cylindrical roller having an empty room, and

(39) a rib formed in a coil and extending in the empty room in the length direction of the cylindrical roller; and

(40) the coiling direction of the rib is reversed at a prescribed position in the lengthwise length direction of the cylindrical roller.

(41) The coiling direction of the rib may be reversed at a lengthwise middle position of the cylindrical roller.

(42) The upstream portions of the coiled rib in the rotation direction of the cylindrical roller may be nearer to the lengthwise middle position of the cylindrical roller than the downstream portions of the rib in the rotation direction adjacent to the upstream portions.

A seventh fixing roller of the present invention for achieving the above objects comprises

(43) a cylindrical roller having an empty room,

(44) a coiled wire extending in the empty room from a first lengthwise end to a second lengthwise end of the cylindrical roller and being in contact with an internal peripheral face of the cylindrical roller to push the inside wall face outward, and

(45) bearings for supporting the cylindrical roller at both lengthwise ends rotatably by contact with the outside periphery of the cylindrical roller; and

(46) the coiled wire presses outward the portions of the outside of the peripheral face opposing to the bearings at a stronger pressure than the other portion.

A eighth fixing roller of the present invention for achieving the above objects comprises

(47) a cylindrical roller having an empty room,

(48) a coiled wire extending in the empty room from a first lengthwise end to a second lengthwise end of the cylindrical roller and being in contact with an internal peripheral face of the cylindrical roller to push the inside wall face outward, and

(49) bearings for supporting the cylindrical roller at the both lengthwise ends rotatably by contact with the outside periphery of the cylindrical roller; and

(50) the wire has a coil pitch shorter at the portions opposing to the bearings than that in other portion.

(51) The portion of the outside peripheral face where the coil pitch of the wire is not shorter may correspond to the portion of nipping the recording medium.

A second fixation assembly of the present invention for achieving the above objects for fixing thermally a developing agent comprises

(52) a fixing roller heated by built-in heat source,

(53) a pressing roller pressed by the fixing roller and is rotated therewith, and

(54) a first temperature sensor placed on a downstream side of a nip between the fixing roller and the pressing roller in a paper delivery direction for detecting a surface temperature of the fixing roller.

(55) The first temperature sensor may be placed at or near the middle of the recording medium path region for use for temperature control of the fixing roller.

(56) The first temperature sensor may be placed at the paper discharge side at the peripheral direction at a roller central angle of not more than 45 degrees relative to perpendicular line to the fixation nip.

(57) The assembly may comprise a second sensor placed at the upstream side in the recording medium delivery direction of the nip between the fixing roller and the pressing roller, and

(58) the second temperature sensor may be used for detecting abnormal high temperature rise of the fixing roller. This second temperature sensor enables a temperature rise at a portion of the roller outside the recording medium path of the thin-wall roller having higher responsiveness than conventional rollers.

(59) The fixing roller may be constituted of a cylindrical roller having relatively thin wall reinforced from inside by a reinforcing member.

The image-forming apparatus of the present invention for achieving the above objects is

(60) provided with the fixing assembly described above.

BRIEF DESCRIPTION OF THE DRAWINGS

FIG. 13(*b*) is a graph showing the nip pressure of the fixing roller of FIG. 13(*a*).

BEST MODE FOR CARRYING OUT THE INVENTION

An embodiment of an image-forming apparatus of the present invention is explained by reference to drawings.

Figure 1:
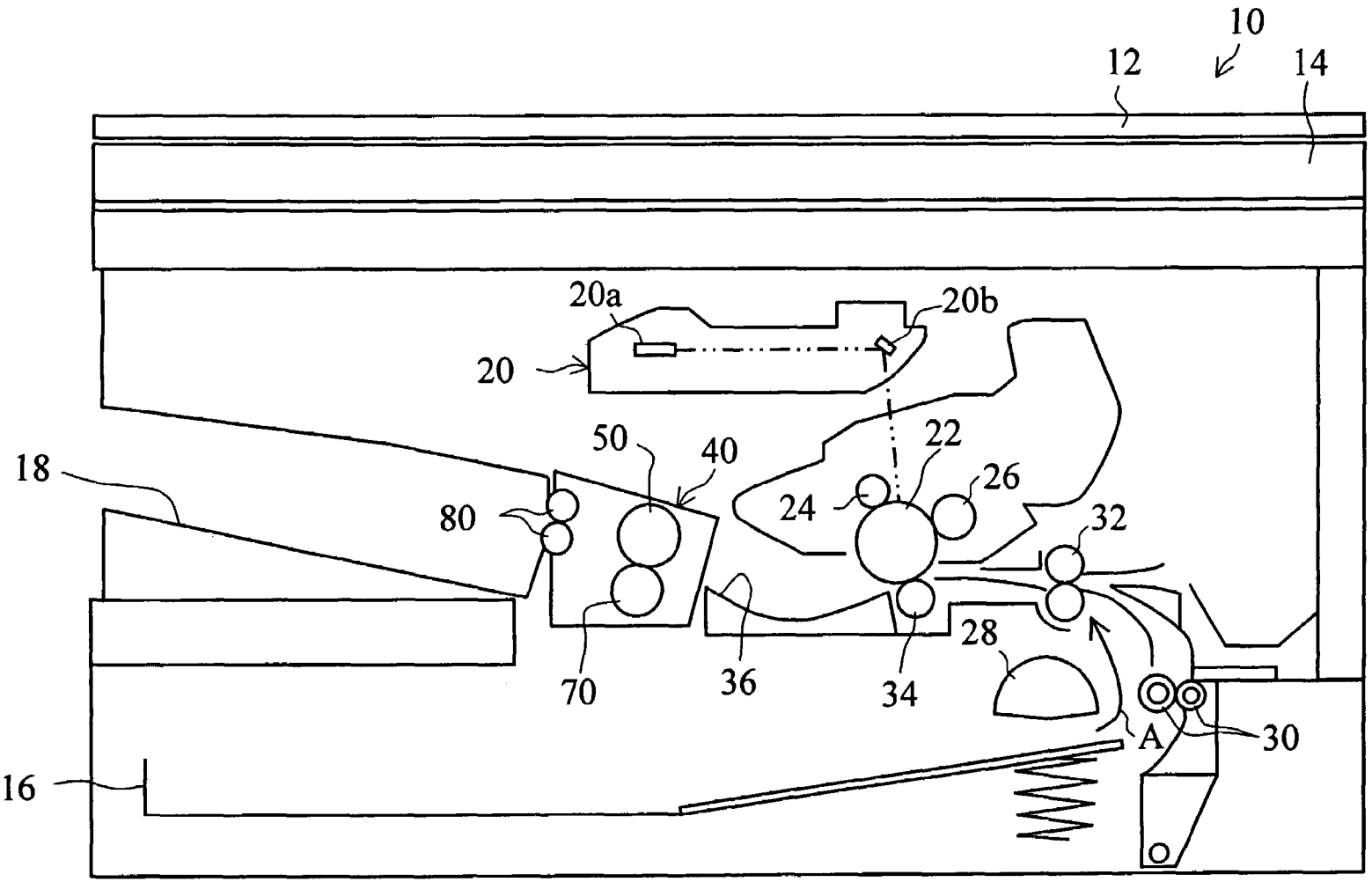
FIG. 1 is a schematic diagram of a digital copying machine as an example of an image-forming apparatus provided with an embodiment of a fixation assembly of the present invention.

An image-forming apparatus having an embodiment of the fixation assembly of the present invention is explained briefly by reference to FIG. 1.

FIG. 1 is a schematic diagram of a digital copying machine which is an example of the image-forming apparatus incorporating an embodiment of the fixation assembly of the present invention.

A rectangular openable document-pressing plate 12 is provided on the top face of the copying machine 10. Under the document-pressing plate 12, an image-reading assembly 14 is provided for reading an image recorded on the original document. The top face (top wall) of the image-reading assembly 14 is a document-supporting glass plate (not shown in the drawing) for supporting an original document for copying.

On the front side of the document-pressing plate 12, a control panel (not shown in the drawing) is provided for inputting the number of copies, and other operation conditions. A cassette 16 for holding out paper sheets is provided demountably at the lower portion of the copying machine 10. A space is formed at the left portion of the copying machine 10. This space serves as a discharged sheet tray 18.

The procedure is explained for forming an image by means of the copying machine 10.

For reproducing the image from an original document onto a recording medium, the document pressing plate 12 is lifted, and the original document is placed on the top face of the document-supporting glass plate (not shown in the drawing) with the image face directed downward, and the original document is fixed by the document-pressing plate 12. Then an operation button is pressed. Thereby the image recorded on the original document is read by an image-reading device 14. The read image is converted into digital signals and the digital signals are transmitted to a laser scanner 20.

The signals transmitted to the laser scanner 20 are converted into a laser beam. The laser beam is projected through a scanner mirror 20*a* rotating at a high speed and through a reflection mirror 20*b* onto a photosensitive drum 22. The photosensitive drum 22 is electrically charged uniformly by electrifier 24. The projected laser beam forms a latent image on the photosensitive drum 22. This latent image is developed with a developing agent fed from a developing roller 26 to form a developed image.

On the other hand, a recording medium like a recording paper sheet is fed from the cassette 16 by sheet feeding roller 28 in the arrow-A direction (sheet feeding direction), and is delivered by a delivering roller 30 and a registering roller 32 to a transferring roller 34. The recording medium is held between the transferring roller 34 and the photosensitive drum 22. The developed image is transferred from the photosensitive drum 22 onto the recording medium. The recording medium having received the transferred developed image is introduced by a delivery guide 36 to a fixation assembly 40. The fixation assembly 40 has a fixing roller 50 and a pressing roller 70, and the recording medium is held and delivered between the rollers 50,70 to have the developed image fixed thereon. The recording medium after fixation of the developed image is discharged by a sheet-discharging roller 80 and is stored in a discharged sheet tray 18.

The fixation assembly 40 is explained below by reference to FIG. 2.

Figure 2:
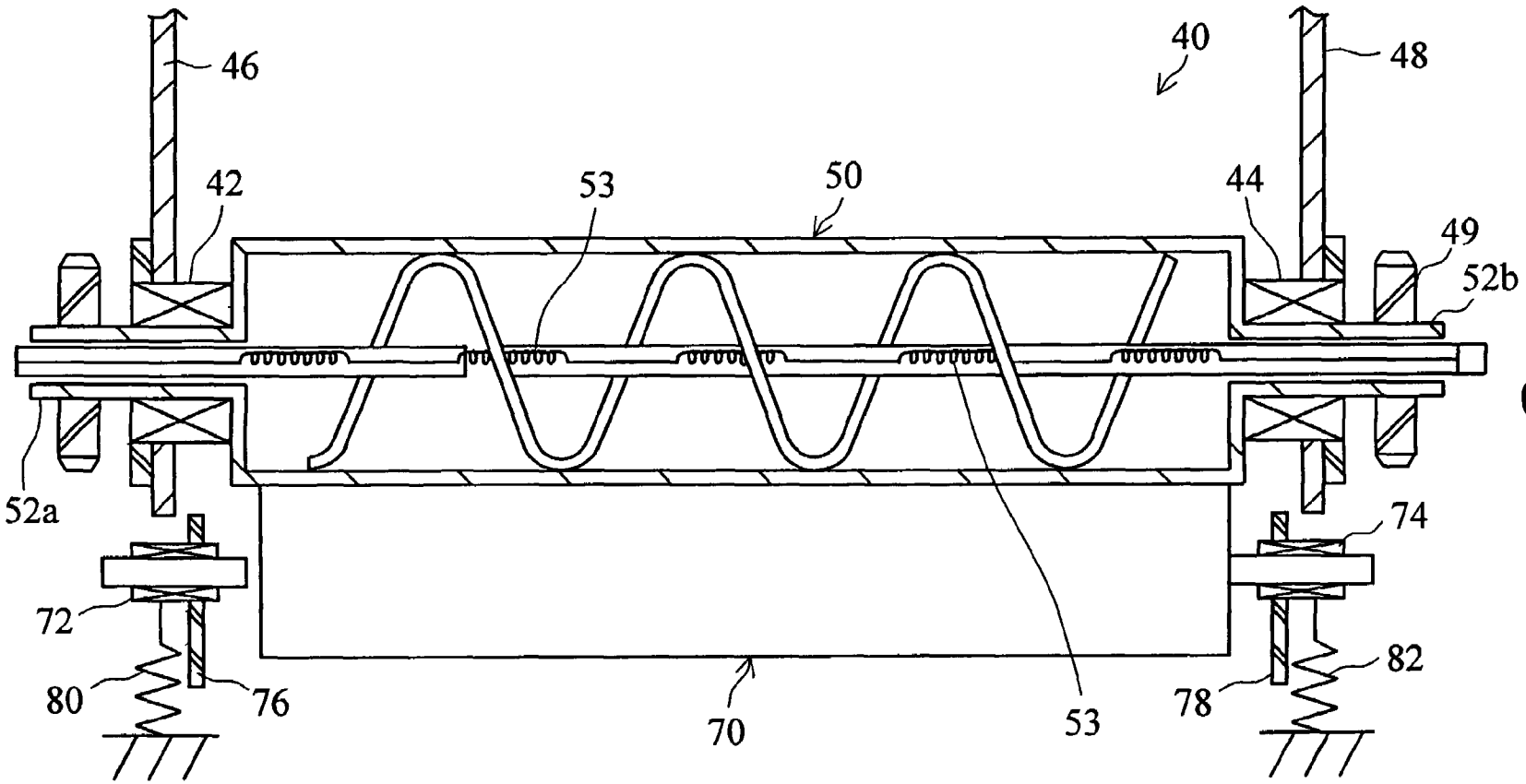
FIG. 2 is a sectional view illustrating an example of the fixation assembly of the present invention.

FIG. 2 is a sectional view illustrating schematically an example of the fixation assembly 40 of the present invention.

The fixation assembly 40 has an empty fixing roller 50 and a pressing roller 70 pressed against the fixing roller 50. The rotation axis of the fixing roller 50 and the rotation axis of the pressing roller 70 are parallel to each other.

The fixing roller 50 is supported rotatably through bearings 42,44 by frames 46,48. Inside the fixing roller 50, an infrared heater 53 is placed for heating the fixing roller 50. The infrared heater 53 is placed at the position corresponding to the rotation axis of the fixing roller 50. At one lengthwise end of the fixing roller 50 (right end in FIG. 2), a gear 49 is fastened. This gear 49 is connected to a driving mechanism of the copying machine 10 (FIG. 1). The driving force of the driving mechanism is transmitted through the gear 49 to the fixing roller 50. The main body of the roller 52 has a journal 52*a*,52*b* at each of the both lengthwise ends for connection with the driving mechanism.

The outside peripheral face of the pressing roller 70 is covered with an elastic rubber layer which is heat-resistant and elastically deformable, like silicone rubber. The both lengthwise ends of the pressing roller 70 are fastened rotatably by bearings 72,74 to frames 76,78 which are different from the frames 46,48. The bearings 72,74 are connected respectively to springs 80,82. Thereby the pressing roller 70 is pushed against the fixing roller 50. The pushing force (energizing force) of the springs 80,82 for pushing the pressing roller 70 can be set arbitrarily. For example, the energizing force can be set at 6 kg for one spring, 12 kg in total. Another kind of elastic member can be used in place of the springs 80,82. The above energizing force is set to obtain a suitable nip space in consideration of the hardness and elasticity of the elastic rubber layer of the pressing roller 70, the recording medium feeding speed, the set temperature, and the like conditions.

The fixing roller is explained by reference to FIG. 3.

Figure 3:
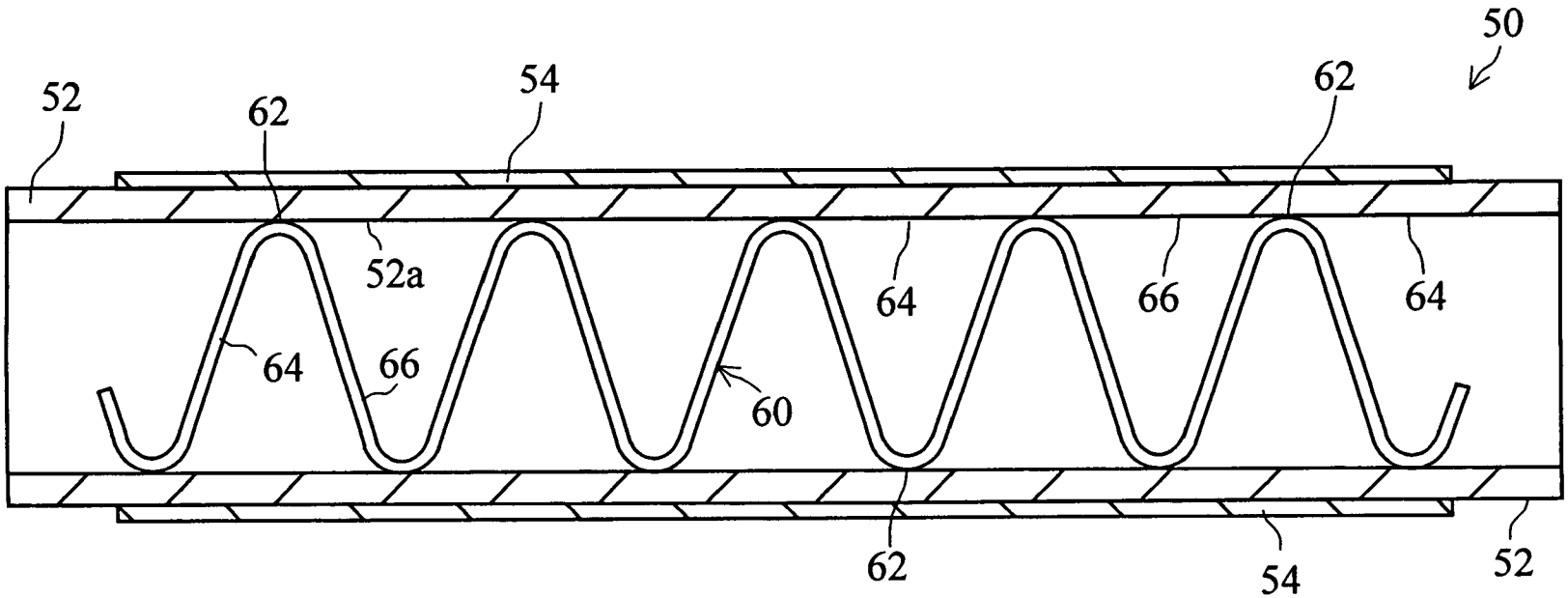
FIG. 3 is a sectional view of the fixing roller.

FIG. 3 is a sectional view of the fixing roller.

The fixing roller 50 has a main roller body 52 in a pipe shape (cylindrical) made of aluminum having a wall thickness of about 0.3-0.5 mm. The outside peripheral face of the main roller body 52 is covered with a releasing layer 54. The releasing layer 54 is formed from a material exhibiting high releasability such as a fluoro-resin, an oil-impregnated silicone rubber, and a silicone rubber layer coated with a fluoro-resin on the surface. The main roller body 52 may be in a straight type having a prescribed uniform diameter, or may be in an inverse crown shape in which the outside diameter is increased gradually from the lengthwise middle portion toward the lengthwise ends.

A coil spring 60 (an example of the reinforcing member of the present invention) is placed in the empty room (interior of the fixing roller 50) of the main roller body 52. The coil spring 60 is kept in contact with the inside wall face 52*a* surrounding the empty room of the main roller body 52 to push the inside wall face 52*a* outward. Further a non-contact area 64 excluding the contact portion 62 between the inside wall face 52*a* and the coil spring 60 is coated with a black-colored film 66. (In FIG. 3, the non-contacting area 64 is not differentiated.)

In this example, a coil spring 60 is used as the reinforcing member. However, any material may used therefor provided that the material has a small heat capacity and exhibits high reinforcing effect. The black-colored film 66 is heat-resistant.

In manufacturing the fixing roller 50, a coil spring 60 is prepared which has an outside coil diameter larger by 1-2% than the inside diameter of the roller main body 52; the coil spring 60 is twisted at the both lengthwise ends in the direction to decrease the outside diameter (in the direction to tighten the winding force); the coil spring in this state is inserted into the empty room of the main roller body 52 having the releasing layer 54 formed on the outside peripheral layer; and in the inside empty room the twist of the coil spring 60 is released. Thereby, the coil spring 60 comes into contact with the inside wall face 52*a* to push the inside wall face 52*a* outward.

The fixing roller 50 having the coil spring 60 placed in the empty room as above is treated for degreasing. Then a black coating paint is applied onto the coil spring 60 and the inside wall face 52*a*, and is baked in a high-temperature oven. The useful black paint includes those containing a heat-resistant pigment composed of a black metal or a black metal oxide. Incidentally, in application of the black paint onto the coil spring 60 and the inside wall face 52*a*, the contact portion 62 does not come to be coated.

An example of the baking finish of the black paint is explained below.

The black paint employed is "Okitsumo 8000" (trade name, Mie Yushi Kako K. K.). This Okitsumo 8000 is a solution of a black metal pigment or a black metal oxide pigment dispersed with a silicone resin binder in a solvent. The formulation thereof comprises a black pigment 15%, an inorganic pigment 20%, a silicone resin (methylphenylsilicone base) 18%, and a solvent 47%.

The baking is conducted at about 300° C. and suitably for about 1-3 hours. These baking conditions depend on the paint employed. By the baking, the black paint applied to the non-contact area 64 of the coil spring 60 and the inside wall face 52*a* forms a heat-resistant black film 66 on the non-contact area 64. On the other hand, since the contact portion 62 is not coated by the black film 66, the inside wall face 52*a* of the fixing roller 50 and the coil spring 60 are electrically connected even if the black film 66 is insulating electrically, whereby the inside wall face 52*a* of the fixing roller 50 and the coil spring 60 are kept at the same electric potential. Therefore no electric discharge will occur therebetween, and electric noise by electric discharge will not be caused. On the other hand, the non-contact area 64, which is coated with the black film 66, absorbs heat of the heater 53 efficiently to heat the releasing layer 54 of the fixing roller 50 rapidly up to the prescribed temperature in a short warming-up time.

The fixing roller 50 should be designed to obtain uniform temperature over the entire width range of the recording medium passage (in the length direction) for uniform fixation of the developed image on the recording medium. Sometimes, for this purpose, watt density of the heater 53 (FIG. 2) is made lower in the lengthwise middle portion than in the both lengthwise end portions of the heater 53. However, immediately after start of the warming-up, owing to the contact of the lengthwise end portions of the heater 53 with the bearings 42,44, the temperature elevation at the lengthwise end portions can be delayed, which may cause non-uniform temperature distribution in the fixing roller 50 to result in incomplete fixation.

To prevent the failure of fixation, depending on the watt distribution of the heater 53, the concentration of the black paint applied onto the inside wall face 52*a* may be changed between the lengthwise middle portion and the lengthwise end portions, or the concentration may be made gradient. Thus the paint concentration need not be uniform over the entire of the inside wall face 52*a*.

When a recording medium of a width smaller than the longer side width of A4-size (longer side width: 297 mm) is allowed to pass continuously through a fixation assembly 40 designed for A4 size sheets, the heat at the lengthwise end portions is not absorbed by the recording medium to cause gradual elevation of the temperature at the end portions of the fixing roller 40, resulting in toner fusion to cause offset. To prevent the offset, the concentration of the black paint applied onto the inside wall face 52*a* may be changed between the lengthwise end portions and the lengthwise middle portion of the inside wall face 52*a*, or the concentration may be made gradient. Thus the paint concentration need not by uniform over the entire of the inside wall face 52*a*.

A second embodiment of the fixing roller is described by reference to FIGS. 4 and 5.

Figure 4:
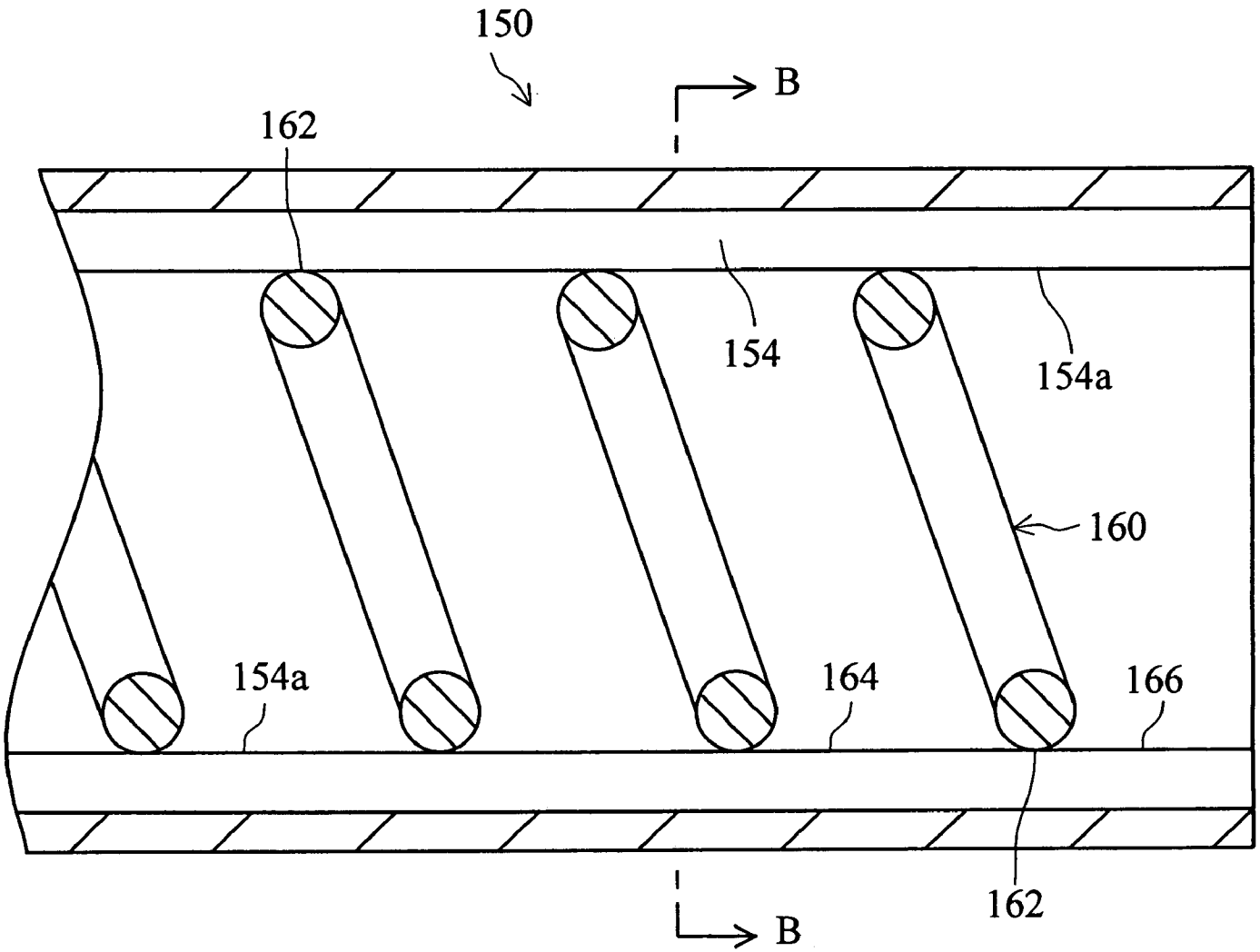
FIG. 4 is a vertical sectional view of a part of a second embodiment of the fixing roller.
Figure 5:
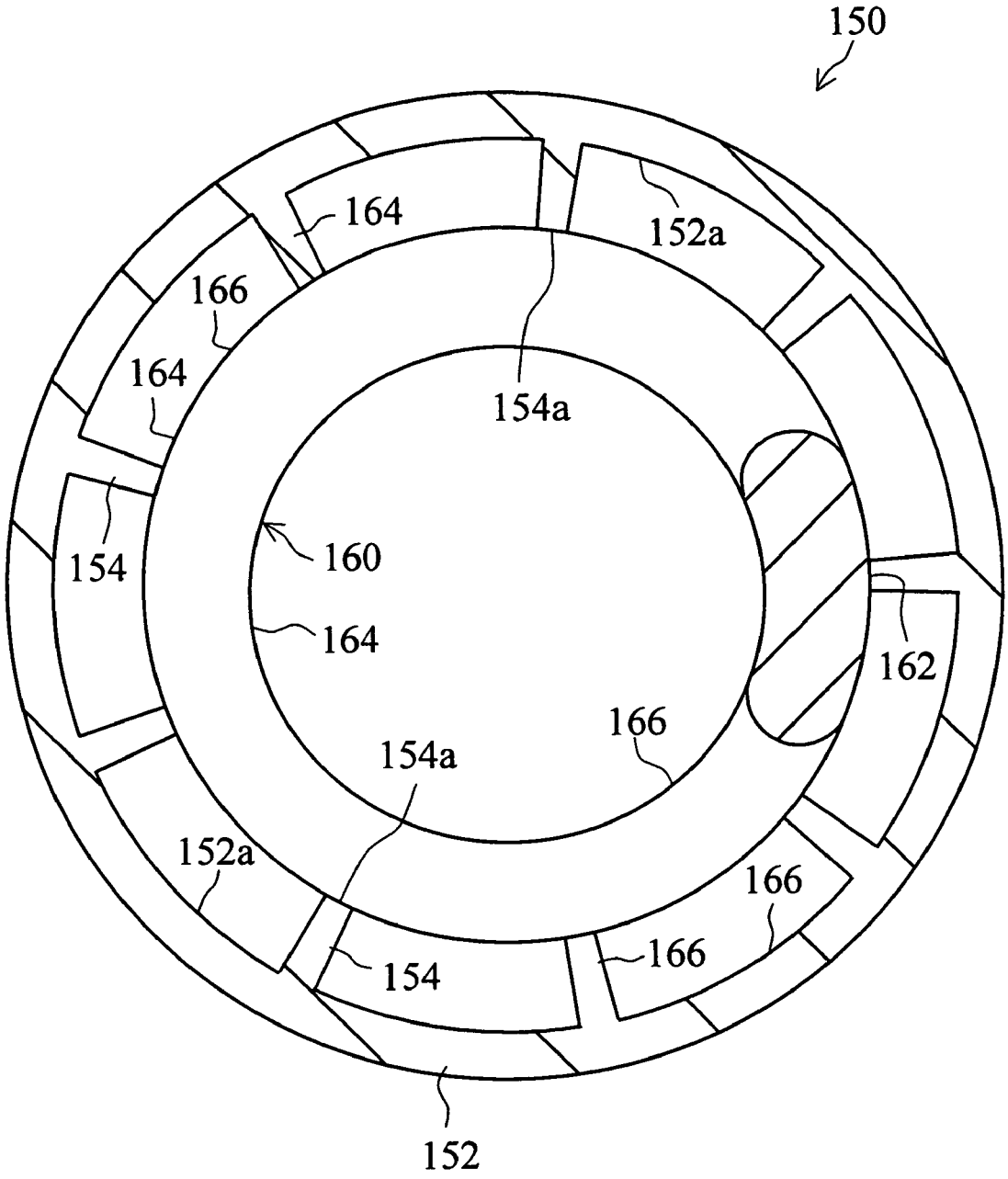
FIG. 5 is a sectional view taken at B-B in FIG. 4.

FIG. 4 is a vertical sectional view of a part of the second embodiment of the fixing roller. FIG. 5 is a sectional view taken at B-B in FIG. 4.

The fixing roller 150 of the second embodiment has characteristically reinforcing ribs 154 on the inside wall of the main roller body 152 for reinforcing the main roller body 152. Incidentally, in FIG. 4 and FIG. 5, a releasing layer, which is formed on the outside peripheral face of the main roller body 152, is not shown.

The reinforcing ribs 154, which are formed in plurality at equal intervals along the periphery direction of the main roller body 152, extend in the length direction of the main roller body 152. In this embodiment, nine ribs 154 are formed.

In the empty room of the main roller body 152 (interior of the fixing roller 150), a coil spring 160 is provided (an example of the reinforcing member of the present invention). This coil spring 160 comes into contact with the top faces 154*a* of the reinforcing rib 154 and pushes the reinforcing ribs 154 and the inside wall face 152*a* of the main roller body 152 outward. The non-contact area 164 of the coil spring 160 and the inside wall face 152*a* are coated with a black film 166 except the contact portion 162 between the coil spring 160 and the inside wall face 152*a* (seemingly in FIG. 5, the black film 166 being not differentiated from the non-contact area 164).

The process of manufacture of the above fixing roller 150 is similar to that of the fixing roller 50 except that the outside diameter of the coil spring 160 is made slightly larger than the inside diameter defined by the top face 154*a* of the reinforcing rib 154.

A third embodiment of the fixing roller is explained by reference to FIGS. 6 and 7.

Figure 6:
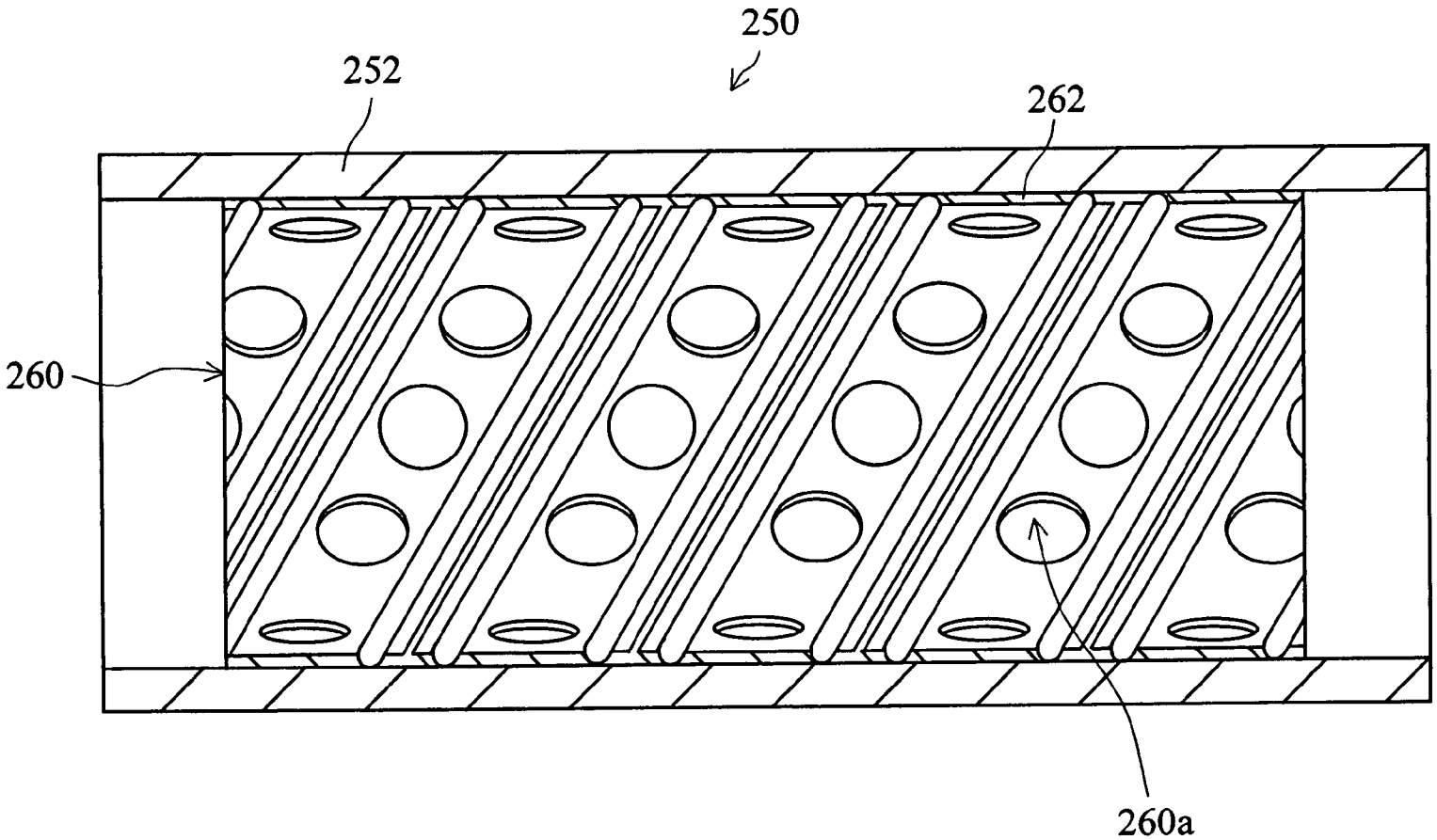
FIG. 6 is a vertical sectional view of a part of a third embodiment of the fixing roller.
Figure 7:
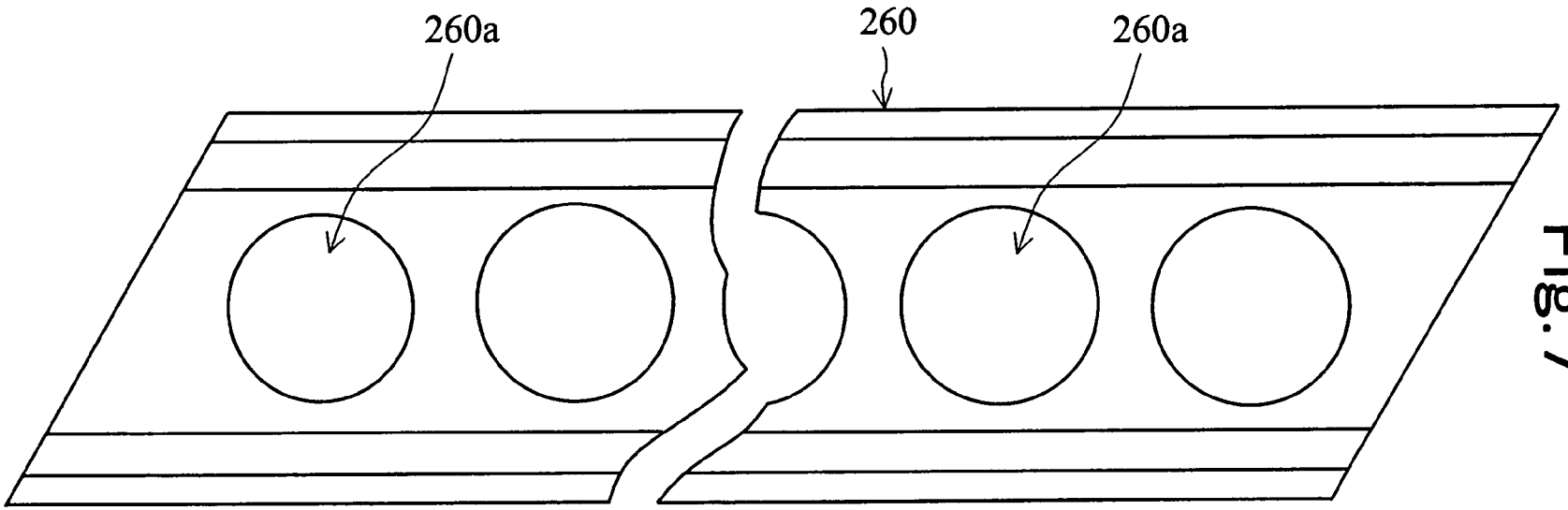
FIG. 7 is an enlarged view of a part of a coil spring placed inside the fixing roller of FIG. 6.

FIG. 6 is a vertical sectional view of a part of the third embodiment of the fixing roller. FIG. 7 is an enlarged view of a part of a coil spring placed inside the fixing roller of FIG. 6.

The fixing roller 250 of the third embodiment comprises a coil spring 260 inside a main roller body 252 for reinforcing the main roller body 252. In FIG. 6, a releasing layer formed on the peripheral face of the main roller body 252 is not shown. The coil spring 260 is formed by winding a belt-shaped plate having many holes 260*a* in a spiral shape. The formed holes 260*a* decrease the heat capacity of the coil spring 260 correspondingly. Thus the fixing roller 250 employs the coil spring 260 in place of the coil spring 60 of the fixing roller 50. The black film and other parts are the same as the ones of the fixing roller 50, the non-contact area being covered with the black film except the contact portion 262. Therefore, the fixing roller 250 achieves the same effect as the fixing roller 50.

A fourth embodiment of the fixing roller is explained by reference to FIG. 8.

Figure 8:
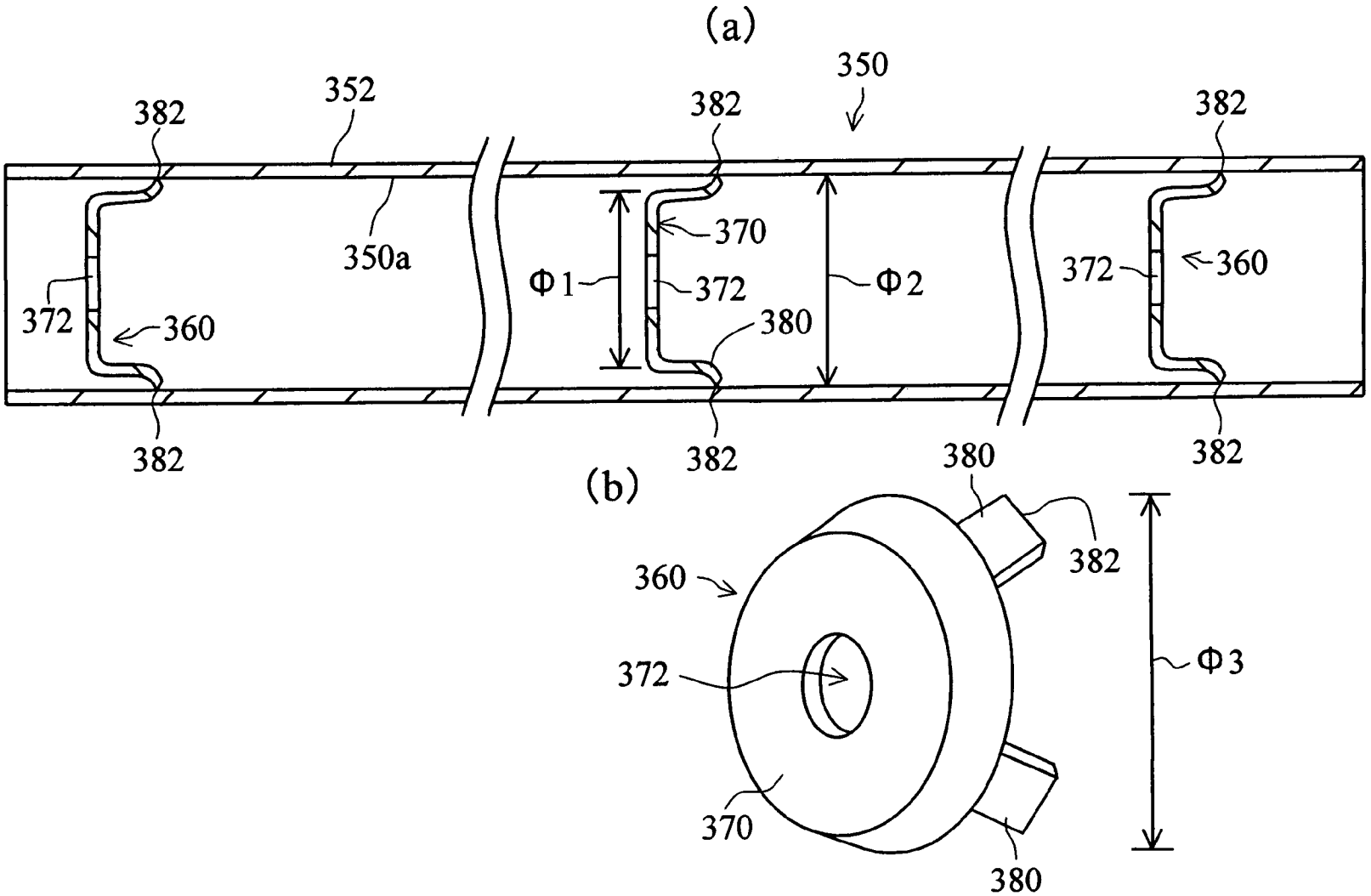
FIG. 8(*a*) is a vertical sectional view of a part of a fourth embodiment of the fixing roller, and FIG. 8(*b*) is a perspective view of a reinforcing member placed in the inside of the fixing roller.

FIG. 8(*a*) is a vertical sectional view of a part of a fourth embodiment of the fixing roller, and FIG. 8(*b*) is a perspective view of a reinforcing member placed inside the fixing roller.

The fixing roller 350 of the fourth embodiment comprises a reinforcing member 360 inside the main roller body 352 for reinforcing the main roller body 352. In FIG. 8, a releasing layer formed on the peripheral face of the main roller body 352 is not shown.

The reinforcing member 360 is constituted of a disk-shaped main body 370 and projections 380. The main body 370 has an outside diameter Φ1 smaller than the inside diameter Φ2 of the fixing roller 350. The main body 370 has a large hole 372 at the middle portion. The heat capacity of the reinforcing member 360 is decreased corresponding to the hole 372.

The plural projections 380 are formed at equal intervals along the peripheral direction of the periphery of the main body 370, being elastic and extending outward. Before insertion into the inside of the fixing roller 350, the diameter Φ3 corresponding to the tip 382 of the reinforcing member 360 is larger than the inside diameter Φ2 of the fixing roller 350. As shown in FIG. 8(*a*), plural reinforcing member 360 are inserted into the inside of the fixing roller 350, whereby the tip portions 382 of the projections 380 comes into contact with the inside wall face 350*a* of the fixing roller 350 to push the inside wall face 350*a* outward. The fixing roller 350 employs the reinforcing members 360 in place of the coil spring 60 of the fixing roller 50. The black film and other parts are the same as the ones of the fixing roller 50, the non-contact area being covered with the black film except the contact portion 382. Therefore, the fixing roller 350 achieves the same effect as the fixing roller 50.

A fifth embodiment of the fixing roller is explained by reference to FIGS. 9-11.

Figure 9:
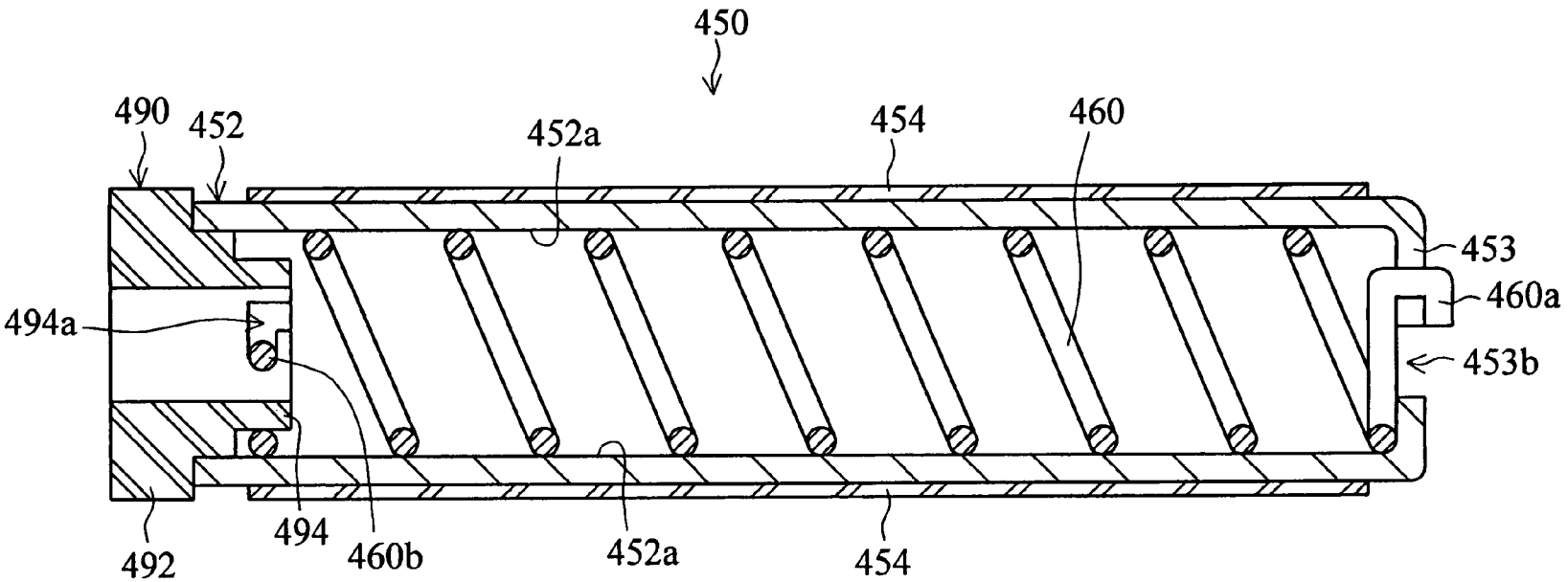
FIG. 9 is a sectional view of a fifth embodiment of the fixing roller.
Figure 10:
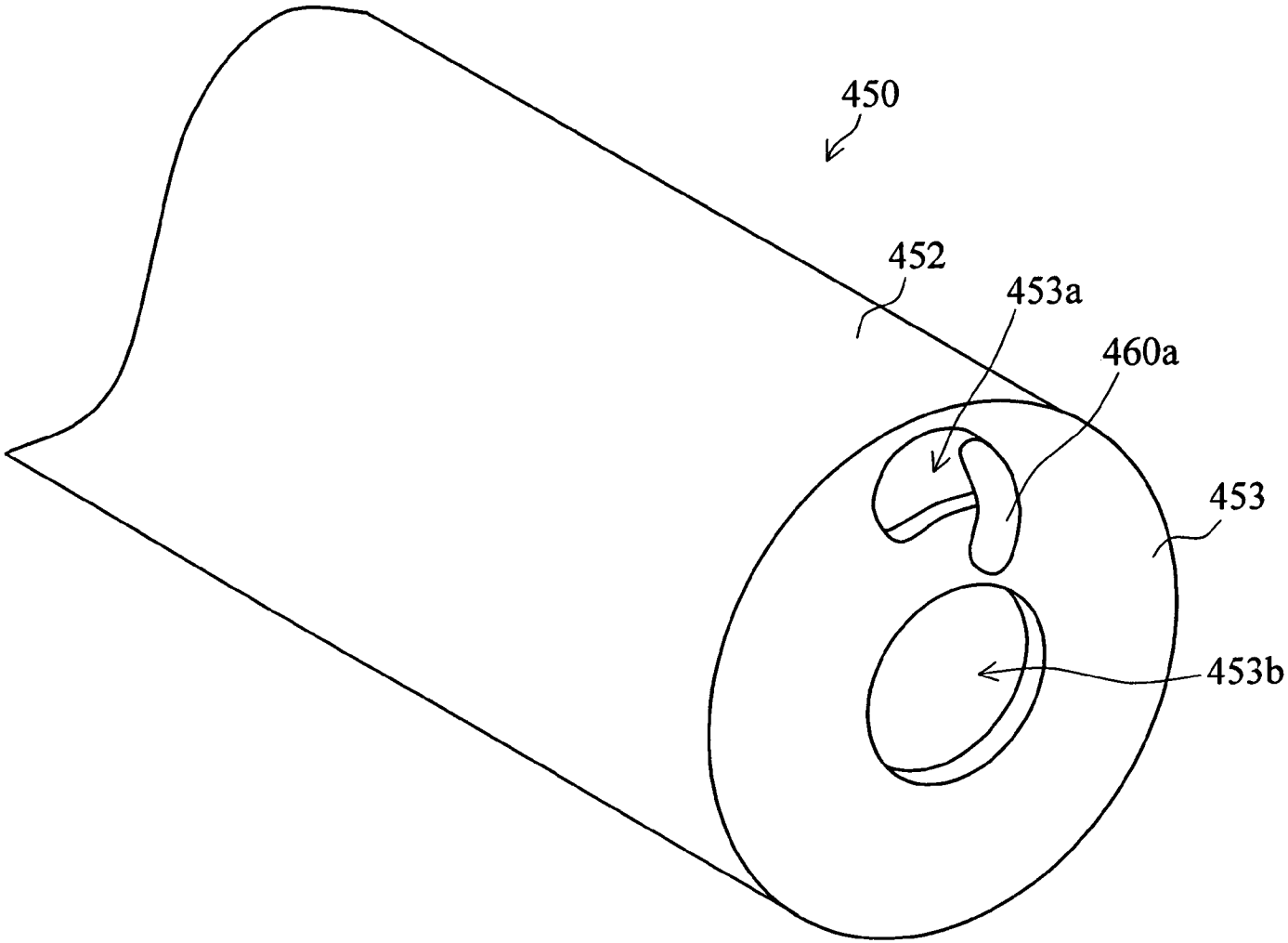
FIG. 10 is a perspective view of a first lengthwise end portion of the fixing roller of FIG. 9.

FIG. 9 is a sectional view of a fifth embodiment of the fixing roller. FIG. 10 is a perspective view of a first lengthwise end portion of the fixing roller of FIG. 9. FIG. 11 is a perspective view of a second lengthwise end portion of the fixing roller of FIG. 9.

The fixing roller 450 has a main roller body 452 in a pipe shape (cylindrical) made of aluminum having a wall thickness of about 0.3-0.5 mm (an example of the cylindrical roller in the present invention). The outside peripheral face of the main roller body 452 is covered with a releasing layer 454. The releasing layer 454 is formed from a material exhibiting high releasability such as a fluoro-resin, an oil-impregnated silicone rubber, and a silicone rubber layer coated with a fluoro-resin on the surface.

A coil spring 460 (an example of the coiled wires in the present invention) wound in a coil shape is placed in the empty room (inside of fixing roller 450) of the main roller body 452. The coil spring 460 is in contact with the inside wall face 452*a* (an example of the inside peripheral face in the present invention) surrounding the empty room in the main roller body 452, pushing (pressing) the inside wall face 452*a* outward. In this embodiment, a coil spring 460 is used as the reinforcing member for reinforcing the main roller body 452, but any material may be used as the reinforcing member insofar as the member has a small heat capacity and achieves high reinforcing effect.

In manufacturing the fixing roller 450, a coil spring 460 is prepared which has a coil outside diameter larger by 1-2% than the inside diameter of the roller main body 452; the coil spring 460 is twisted at the both lengthwise ends in the direction to decrease the outside diameter (in the direction to tighten the winding force); the coil spring in this state is inserted into the empty room of the main roller body 452 having the releasing layer 454 formed on the outside peripheral layer 54; and in the inside empty room the twist of the coil spring 460 is released. Thereby, the coil spring 460 comes into contact with the inside wall face 452*a* to push the inside wall face 452*a* outward.

A circular lid 453 is formed at on lengthwise end of the main roller body 452 so as to close the opening of the cylinder. This lid 453 has an ellipsoidal hole 453*a* as shown in FIG. 10. The aforementioned coil spring 460 extends spirally in the empty room of the main roller body 452 in the length direction of the main roller body 452 with a first end 460*a* of the coil spring 460 hooked to the hole 453*a* to fasten the first end 460*a* of the coil spring 460 to the one lengthwise end of the main roller body 52. At the center portion of the lid 453, a circular hole 453*b* is formed.

A driving gear 490 (an example of the gear in the present invention) is provided at a second lengthwise end of the main roller body 452 as shown in FIG. 9. This driving gear 490 transmits the driving force to the main roller body 452 to rotate the main roller body 452. The gear portion 492 (tooth portion) of the gear 490 is placed outside the main roller body 452, while a fitting portion 494 of the driving gear 490 (other than the gear portion 492) is fitted into the main roller body 452.

Figure 11:
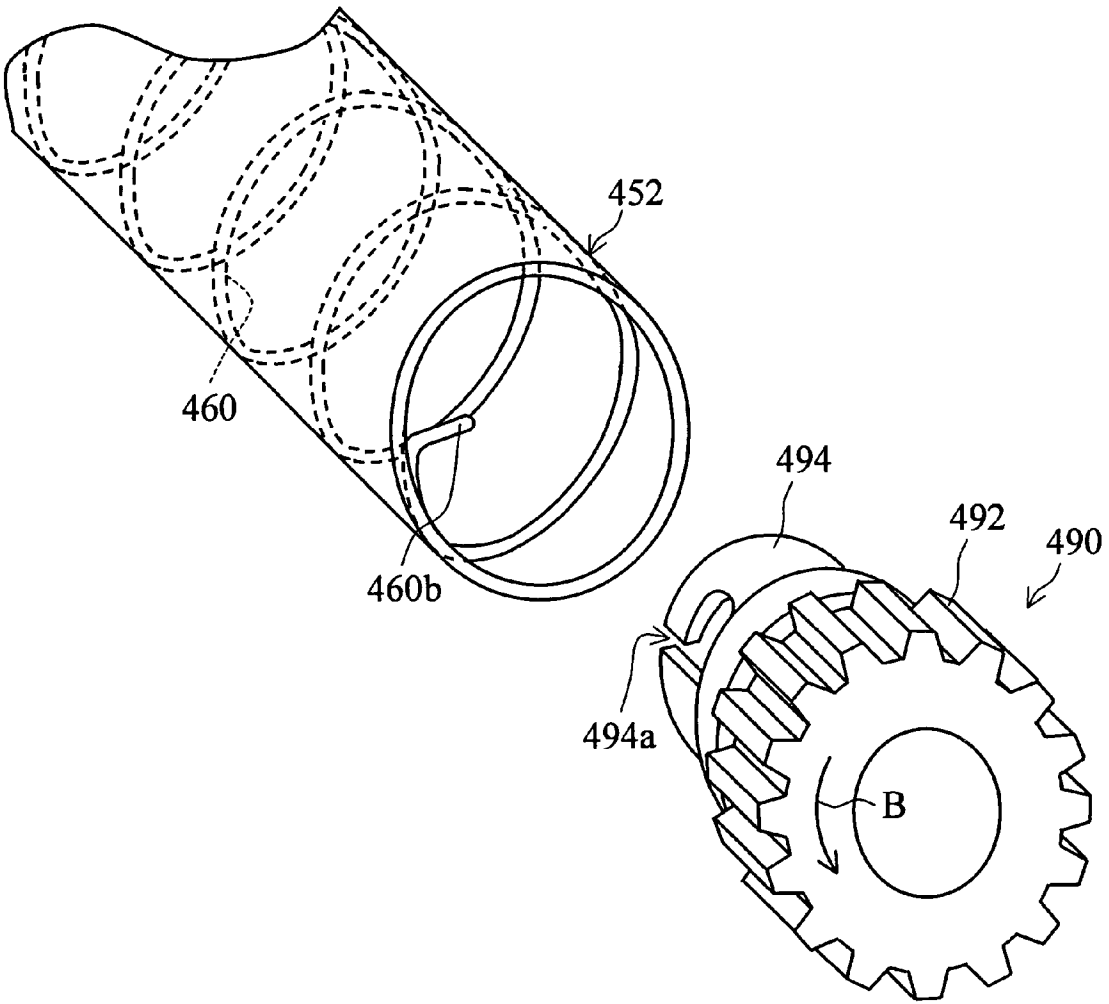
FIG. 11 is a perspective view of a second lengthwise end portion of the fixing roller of FIG. 9.

The fitting portion 494 of the driving gear 490 has an L-shaped nick 494*a* as shown in FIG. 11. A second end 460*b* opposite to a first end 460*a* of the coil spring 460 is pushed into the nick 494*a* to fasten the second end 460*b* of the coil spring 460 to the driving gear 490. The driving gear 490 is pulled by the coil spring 460 toward the first lengthwise end (portion having the lid 453) of the main roller body 452. Thereby the coil spring 460 prevents fall-off of the driving gear 490 from the main roller body 452, which makes unnecessary an additional member for prevention of fall-off of the driving gear 490.

The driving gear 490 is rotated in the arrow-B direction as shown in FIG. 11. The rotation in this B-direction gives an effect to enlarge the winding diameter (coil outside diameter) of the coil spring 460. With rotation of the driving gear 490 in the arrow-B direction, the coil diameter of the coil spring tends to be expanded, and the coil spring 460 is brought into contact entirely with the inside wall face 452*a* of the main roller body 452 and pushes the inside wall face 452*a* outward. Thus the driving force transmitted from the driving gear 490 to the coil spring 460 is distributed in the entire of the main roller body 452 to rotate the main roller body 452. In such a manner, the driving force of the driving gear 490 is distributed throughout the main roller body 452 without local concentration. Therefore, a main roller body 452 having a small wall thickness can be rotated without break of the main roller body 452. Moreover, the coil spring 460 pushes the inside wall face 452*a* of the main roller body 452 outward, resulting in reinforcement of the main roller body 452 by the coil spring 460.

A sixth embodiment of the fixing roller is explained by reference to FIG. 12.

Figure 12:
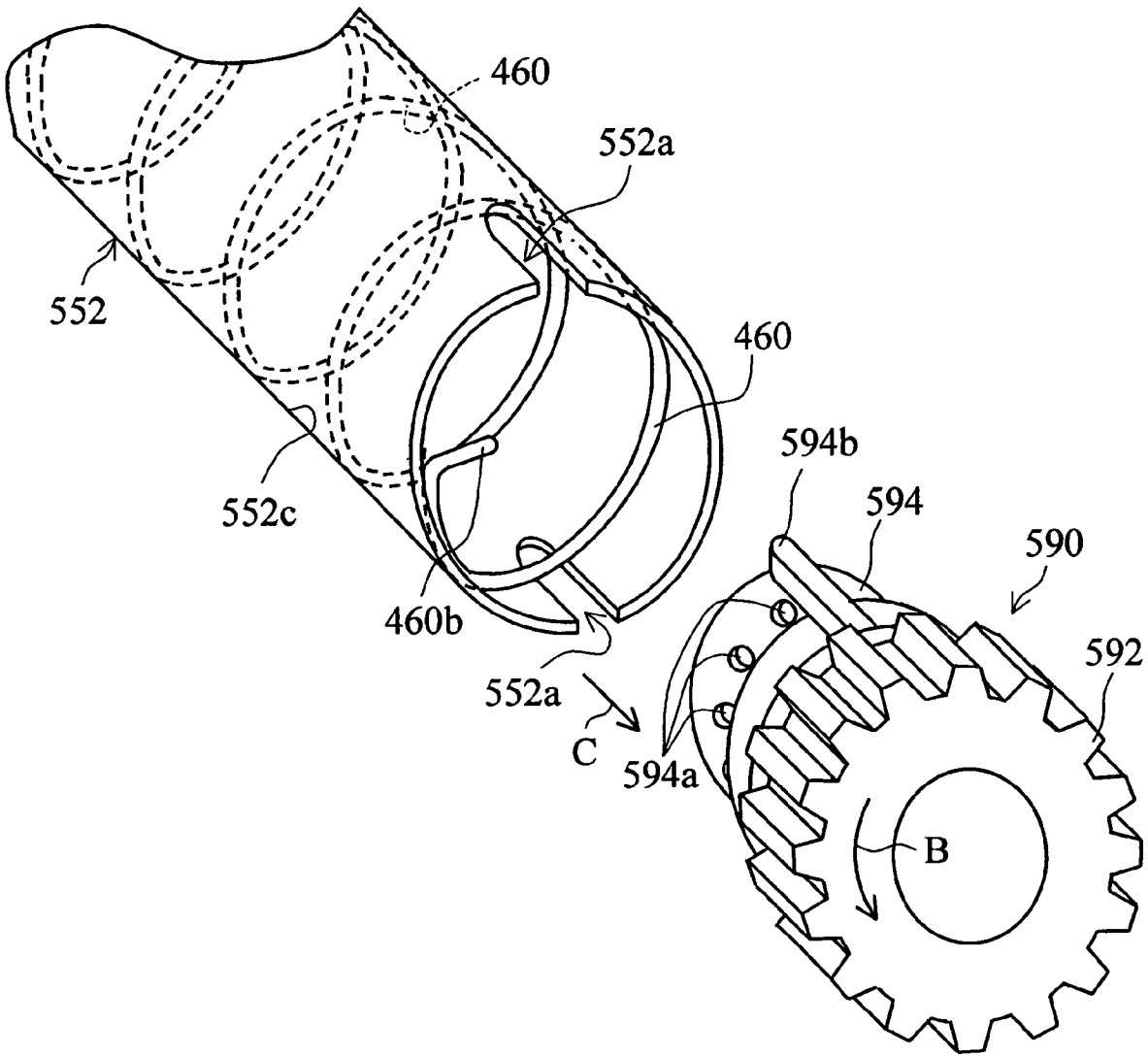
FIG. 12 is a perspective view of a second lengthwise end portion of a roller main body of a sixth embodiment and a driving gear thereof.

FIG. 12 is a perspective view of a lengthwise second end portion of a roller main body of a sixth embodiment and a driving gear thereof. In FIG. 12, the same reference symbols are used for indicating the corresponding constitutional elements. The first lengthwise end of the main roller body 552 has the same structure as that of the main roller body 452 shown in FIG. 9.

A driving gear 590 (an example of the gear in the present invention) is attached at a lengthwise second end of the main roller body 552 (an example of the cylindrical roller of the present invention). This driving gear 590 transmits the driving force to the main roller body 552 to rotate the main roller body 552. The gear portion 592 (tooth portion) of the gear 590 is placed outside the main roller body 552, while a fitting portion 594 of the driving gear 590 (excluding the gear portion 592) is fitted into the main roller body 552.

The fitting portion 594 of the driving gear 590 has holes 594*a* on the cylindrical part of the fitting portion 594. A second end 460*b* of the coil spring 460 is inserted into any of the holes 594*a* to be hooked there. Thereby the second end 460*b* of the coil spring 460 is fastened to the driving to the driving gear 590, and the driving gear 590 is pulled toward the lengthwise first end (portion having the lid 453 (FIG. 10)) of the main roller body 552. Thereby the coil spring 460 prevents fall-off of the driving gear 590 from the main roller body 552, which makes unnecessary an additional member for prevention of fall-off of the driving gear 590.

Since the driving gear 590 has plural holes 594*a* as mentioned above, the end portion 460*b* can be inserted surely into any of the holes 594*a* even if the position of the end portion 460*b* varies by variation in the manufacturing process of the coil spring 460.

At the second lengthwise end of the main roller body 552, two slits 552*a* extending in the arrow-C direction are formed in opposition to each other (180° intervals in periphery direction), and correspondingly, ribs 594*b* are formed to fit into the tow slits 552*a* (only one rib shown in FIG. 12).

When the driving gear 590 is rotated, the driving force for the rotation is transmitted to the coil spring 460, and directly to the main roller body 552 through the ribs 594*b* and the slits 552*a*. The driving force transmitted directly to the main roller body 552 through the ribs 594*b* and the slits 552*a* is weaker than the driving force transmitted to the coil spring 460 through the driving gear 590. That is, the driving force transmitted to the coil spring 460 is stronger than the driving force transmitted through the ribs 594*b*. Therefore, the ribs 594*b* and the slit 552*a* play an auxiliary role in transmitting the driving force to the main roller body 552. The driving force transmitted to the coil spring 460 is distributed, similarly as in transmission through the driving gear 590 to the coil spring 460, and is transmitted more dispersedly to the main roller body 552.

A procedure of inserting the end 460*b* of the coil spring 460 into any of the holes 594*a* is explained below.

The hole 594*a* to which the end 460*b* is inserted is selected in such a manner that the distance along the periphery (second distance) between the hole 594*a* to insert the end 460*b* of the coil spring 460 and the rib 594*b* of the driving gear 590 is longer than the distance along the periphery (first distance) between the slit 552*a* of the main roller body 552 and the end 460*b* of the coil spring 460. After this selection, the end 460*b* is pulled out in the arrow-C direction and is inserted into the selected hole 594*a*. By setting the second distance longer than the first distance, the coil spring 460 pushes outward the inside wall face 552*c* of the main roller body 552. If the second distance is shorter than the first distance, the coil spring 460 does not come into contact with the inside wall face 552*c* of the main roller body 552. In this state, the driving force from the driving gear 590 is not dispersed to the coil spring 460 to cause concentration of the driving force at the slit 552*a* to destroy the slit 552*a*.

In the above examples the roller of the present invention is used as a fixing roller. However, the fixing roller of the present invention is applicable to cylindrical thin-wall rollers such as a photosensitive drums and development sleeves.

A seventh embodiment of the fixing roller is explained below by reference to FIGS. 13-15.

Figure 13:
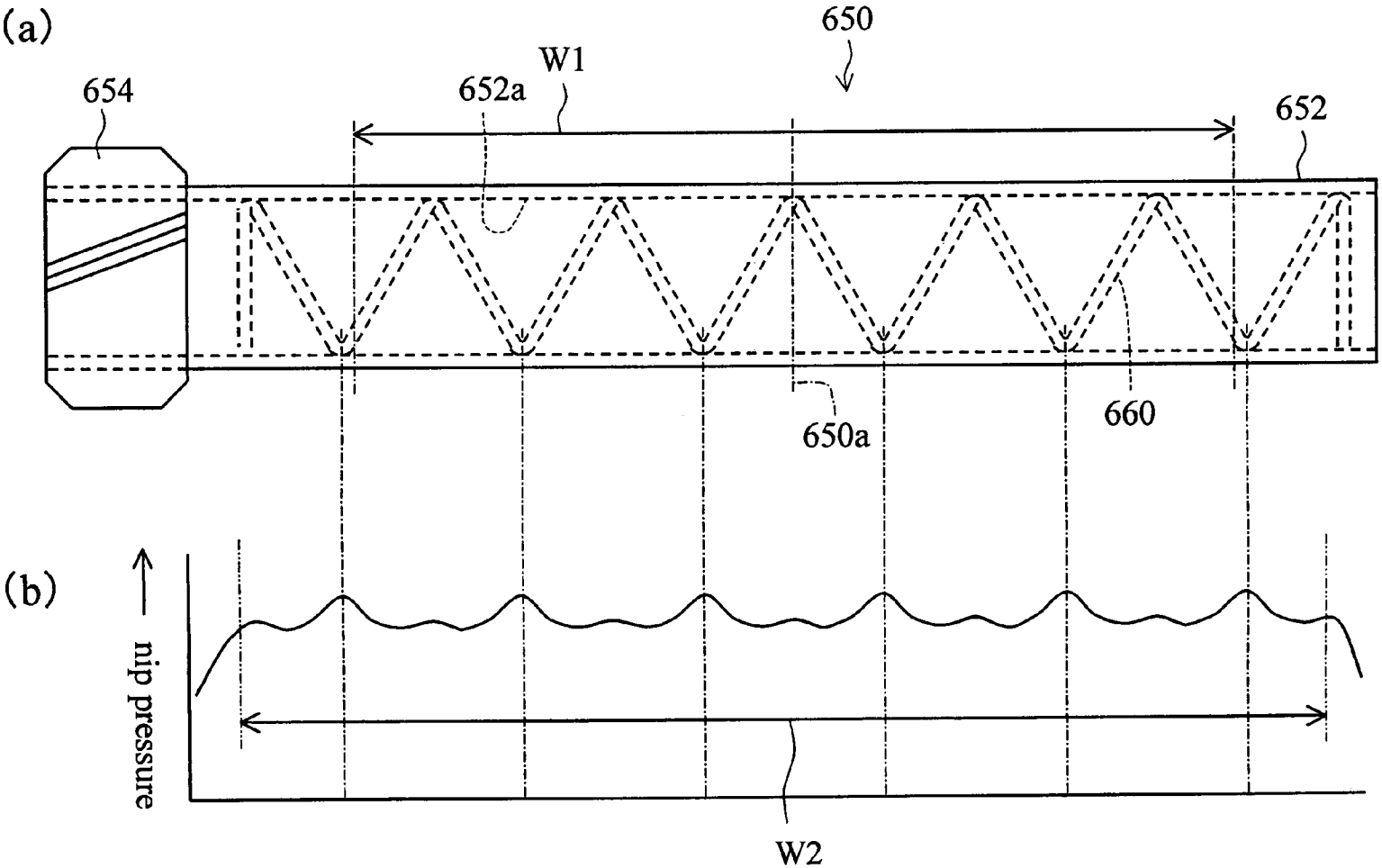
FIG. 13(*a*) is a schematic view illustrating the inside of a seventh embodiment of the fixing roller.
Figure 14:
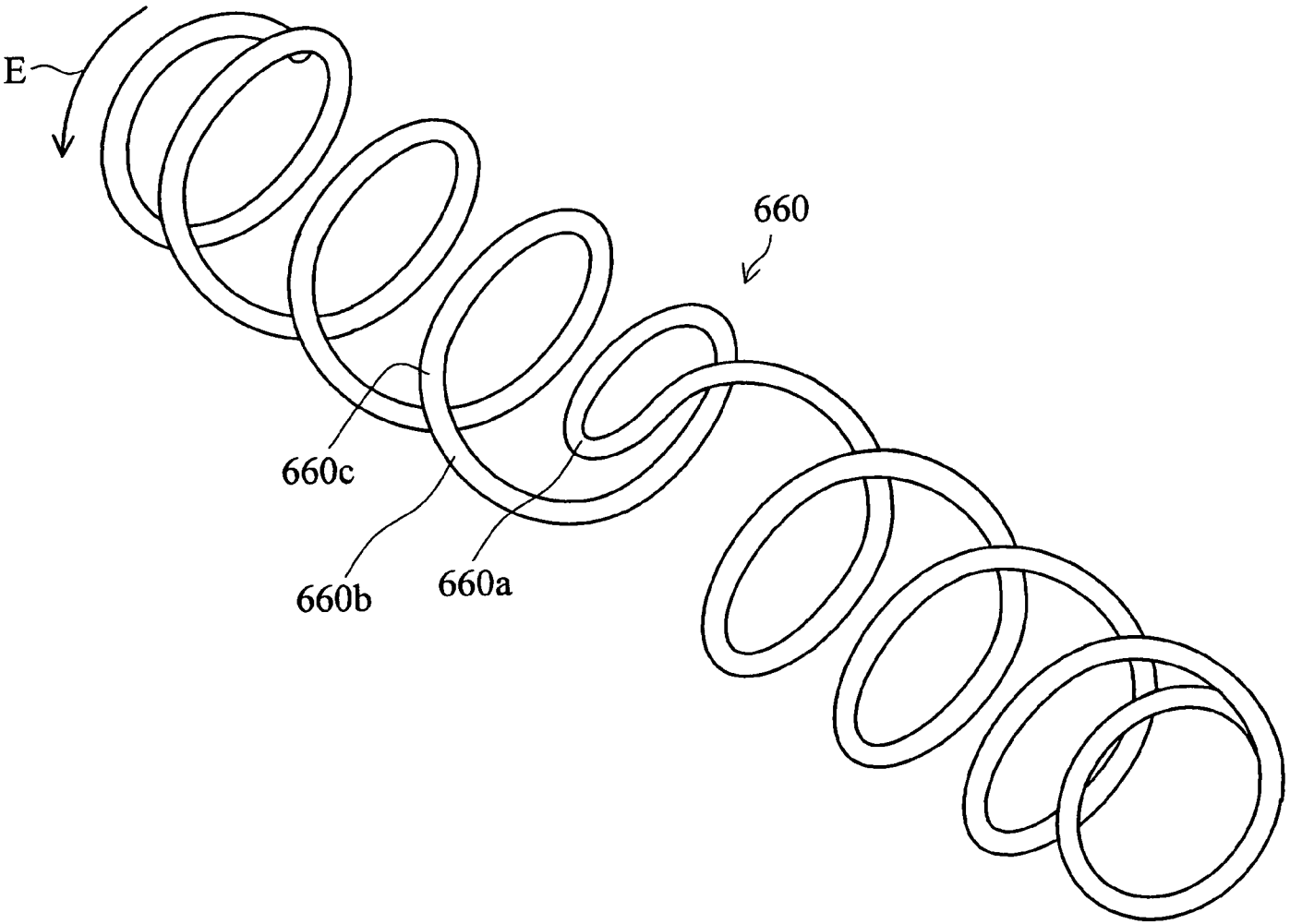
FIG. 14 is a perspective view of a coil spring.

FIG. 13(*a*) is a schematic view illustrating the interior of a seventh embodiment of a fixing roller. FIG. 13(*b*) is a graph showing the nip pressure of the fixing roller of FIG. 13(*a*). FIG. 14 is a perspective view of a coil spring. FIG. 15 is a sectional view of the fixing roller of FIG. 13 delivering a recording paper sheet.

The fixing roller 650 is provided with a fixing roller pipe 652 (an example of the cylindrical roller of the present invention) constituted of an aluminum-magnesium alloy in a pipe shape (in a hollow cylinder shape). The fixing roller pipe 652 is manufactured by machining to have a wall thickness in the range of 0.28-0.32 mm over the entire range. The outside peripheral face of the fixing roller pipe 652 is covered with a releasing layer (not shown in the drawing). The releasing layer is formed from a material exhibiting high releasability such as a fluoro-resin, an oil-impregnated silicone rubber, and a silicone rubber layer coated with a fluoro-resin on the surface.

A coil spring 660 (an example of coiled wires in the present invention) coiled in a screw shape is placed in the empty room (inside of fixing roller 650) of the fixing roller pipe 652. The outside diameter of the coil spring 660 is made to be larger by about 0.1-0.5 mm than the inside diameter of the fixing roller pipe 652. Thereby the coil spring 660 is in contact with the inside wall face 652*a* (an example of the inside peripheral face in the present invention) surrounding the empty room in the fixing roller pipe 652, pushing (pressing) the inside wall face 652*a* outward. The coil spring 660 is fastened to the fixing roller pipe 652 to rotate together with the fixing roller 652.

In manufacturing the aforementioned fixing roller pipe 650, a coil spring 660 is prepared which has a coil outside diameter larger by about 0.1-0.5 mm than the inside diameter of the fixing roller pipe 652; the coil spring 660 is twisted at the both lengthwise ends in the direction to decrease the outside diameter (in the direction to tighten the winding force); the coil spring in this twisted state is inserted into the empty room of the fixing roller pipe 652; and the twist of the coil spring 660 is released. Thus, the coil spring 660 comes into contact with the inside wall face 652*a* to push the inside wall face 652*a* outward. Thereby the fixing roller pipe 652 is reinforced by the coil spring 660 so as not to be deformed by the pressure of the pressing roller 650.

At a first lengthwise end of the fixing roller 652, a driving gear 654 is attached as shown in FIG. 13. This driving gear 654 transmits a driving force to the fixing roller 652 to rotate the fixing roller 652.

Of the peripheral face of the fixing roller pipe 652, the portion corresponding to the contact portion of the coil spring 660 is pressed outward stronger than the non-contact area thereof. Accordingly the nip pressure caused by pressing with the pressing roller 70 (FIG. 1) against the fixing roller 650 is higher at the portion of the fixing roller 652 where the coil spring 660 is in contact than other portion as shown in FIG. 13(*b*). However, the variation of the nip pressure in the length direction of the fixing roller 650 will not affect adversely the fixability. In FIG. 13(*b*), the ordinate shows a nip pressure, and the abscissa shows a length direction. The symbol W1 in FIG. 13 represents the region where the recording medium is allowed to pass (sheet passage region), and W2 represents the region which is pressed by the pressing roller 70. The region W2 is larger than the region W1, and the coil spring 660 extends over the region larger than the region W2.

The coil spring 660, as mentioned above, is wound spirally in the empty room of the fixing roller pipe 652 and extends in the length direction of the fixing roller pipe 652, and is brought into contact with the inside wall face of the fixing roller pipe 652 to push the inside wall face outward. The winding direction of the coil spring 660 is reversed at the middle 660*a* of the coil. That is the direction of winding of the coil spring 660 is changed at the middle (an example of the prescribed position in the length direction of the present invention) in the length direction of the fixing roller pipe 652. When the coil spring 660 is inserted into the empty room of the fixing roller pipe 652, the middle portion 660*a* of the coil spring is placed at the lengthwise middle position of the fixing roller pipe 652.

The coil spring 660 is wound spirally such that an upstream portion (e.g., portion 660*b*) of the coil spring 660 in the rotation direction of the fixing roller pipe 652 is nearer to the lengthwise middle position of the fixing roller pipe 652 than the downstream side (e.g., 660*c*) in the rotation direction adjacent to the upstream portion. The coil spring 660 is rotated in the arrow-E direction with the rotation of the fixing roller pipe 52.

Figure 15:
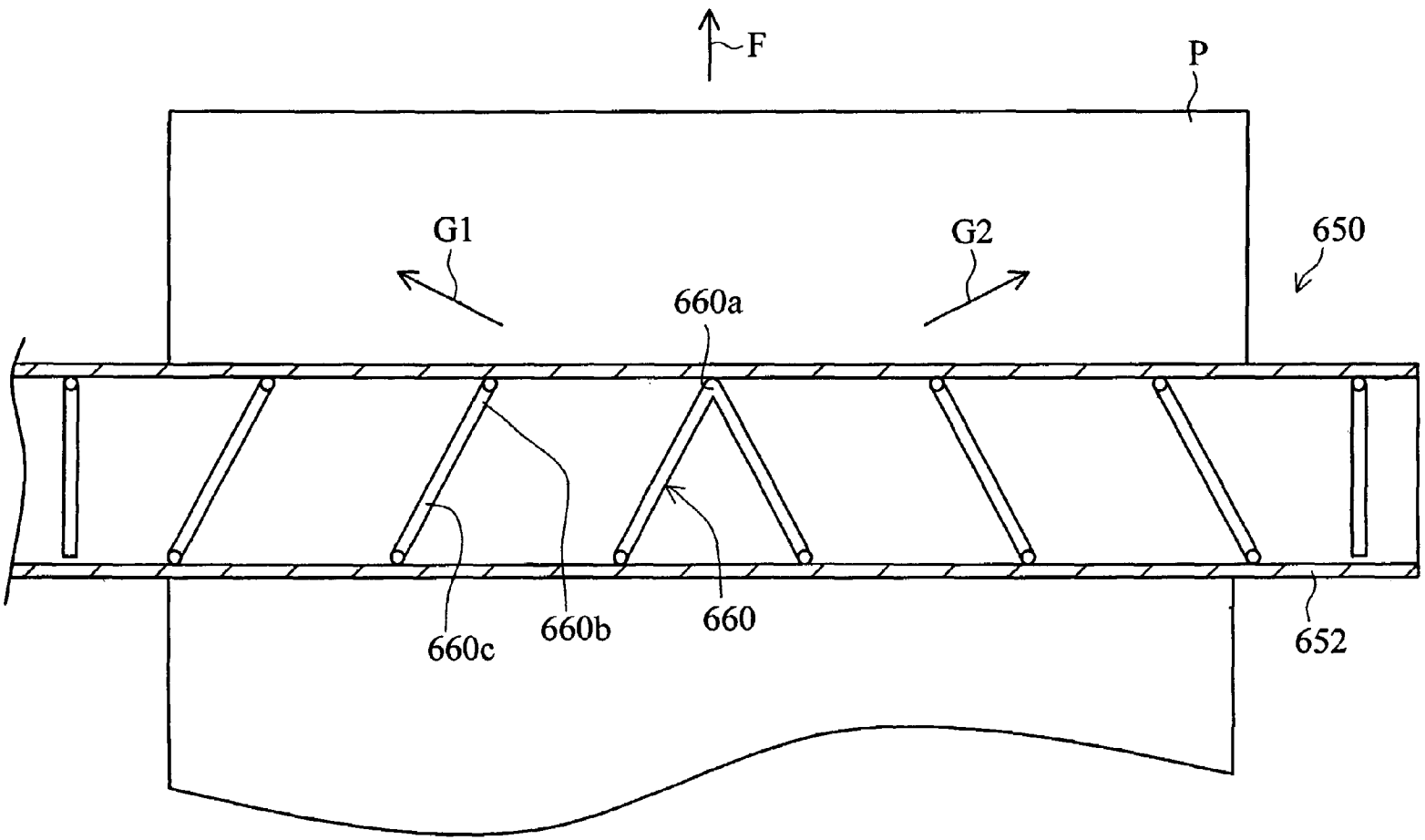
FIG. 15 is a sectional view of the fixing roller of FIG. 13 delivering a recording paper sheet.

As shown in FIG. 15, when a recording medium P is held between the fixing roller 650 and pressing roller 70 (FIG. 1) with the lengthwise middle portion of the recording medium positioned at the middle portion 660*a* of the coil spring 660 and is delivered in this state in the arrow-F direction, the portions (e.g., 660*b*, 660*c*) of a higher nip pressure are moved along the surface of the recording medium P from the lengthwise middle portion toward the lengthwise end portions of the fixing roller 650. Therefore, the recording medium P is pulled at one side of the lengthwise middle portion in the arrow-G1 direction and at the other side in arrow-G2 direction during delivery in the arrow-F direction. Consequently, the recording medium P is less liable to be fed obliquely, and is delivered to with stretching not to cause wrinkling.

In the above example, the coil spring 660 is one continuous coil, but instead may be formed from plural coil springs shorter than the fixing roller pipe 652 joined together.

An eighth embodiment of the fixing roller is explained below by reference to FIG. 16.

Figure 16:
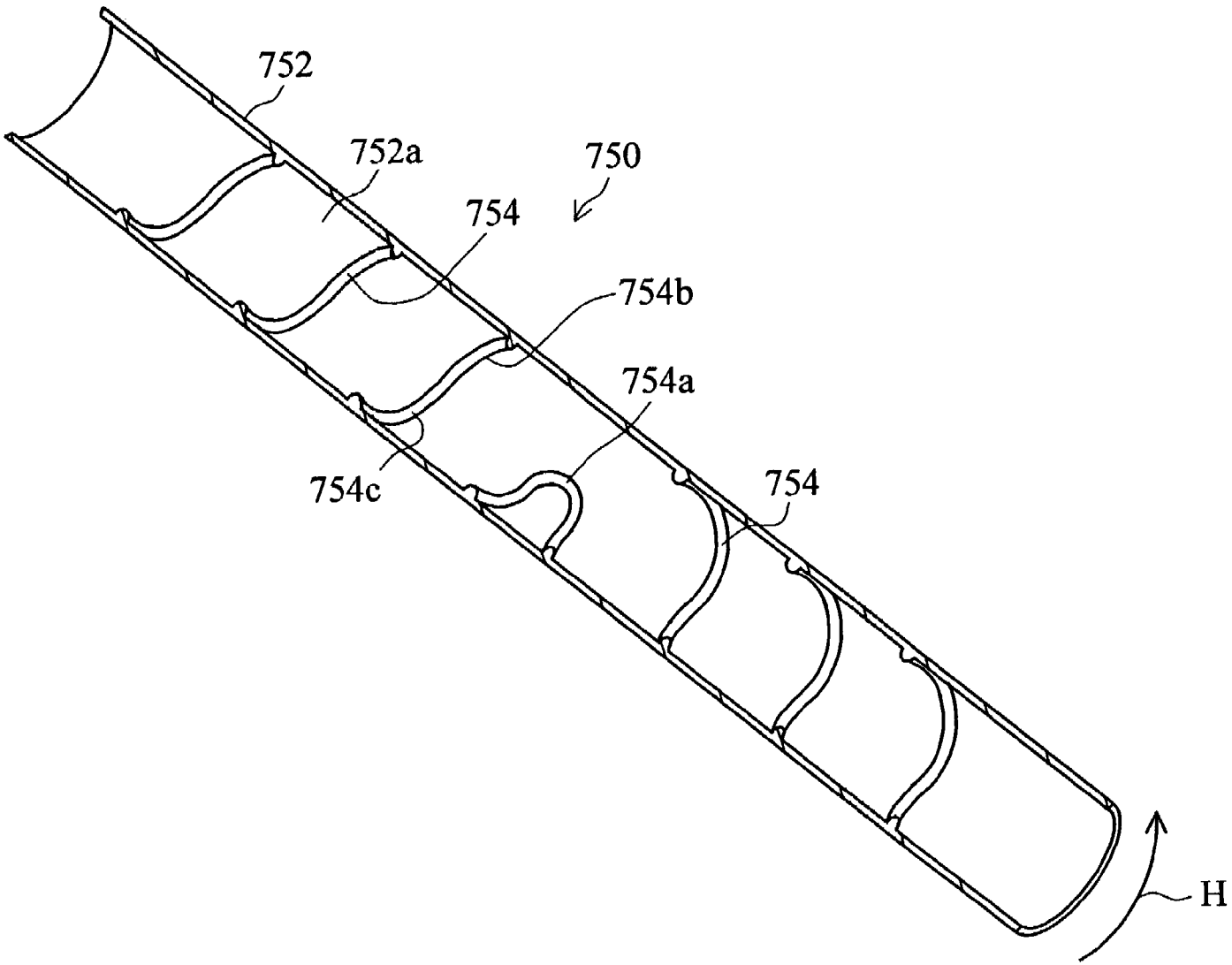
FIG. 16 is a perspective view illustrating the inside of an eighth embodiment of the fixing roller out in the lengthwise direction.

FIG. 16 is a perspective view illustrating the inside of the eighth embodiment of the fixing roller cut in the lengthwise direction.

The fixing roller 750 comprises a fixing roller pipe 752 (an example of the cylindrical roller of the present invention) constituted of an aluminum-magnesium alloy in a pipe shape (in a hollow cylinder shape). The fixing roller pipe 752 has an outside diameter at the lengthwise middle portion smaller by about 0.15 mm smaller than the outside diameter at the lengthwise ends thereof. Therefore, the fixing roller pipe 752 is in an inversed crown shape. The fixing roller pipe 752 has a wall thickness of 0.30 mm at the lengthwise middle portion, and 0.35 mm at the lengthwise end portions. The outside peripheral face of the fixing roller pipe 752 is covered with a releasing layer (not shown in the drawing). The releasing layer is formed from a material exhibiting high releasability such as a fluoro-resin, an oil-impregnated silicone rubber, and a silicone rubber layer coated with a fluoro-resin on the surface.

On the inside peripheral face 752*a* of the fixing roller pipe 752, rib 754 is formed in a shape of a spiral extending in the length direction of the fixing roller pipe 752. This rib 754 rises from the inside peripheral face 752*a* inward. The fixing roller pipe 752 is reinforced by the rib 754, so that the fixing roller pipe 752 is not deformed even when the fixing roller 750 is pressed by the pressing roller 70 (FIG. 1).

The rib 754 is in a spiral shape with the spiral direction reversed at the middle 754*a* of the spiral. The rib 754 is formed spirally such that an upstream portion (e.g., portion 754*b*) of the rib 754 in the rotation direction (arrow-H direction) of the fixing roller pipe 752 is nearer to the lengthwise middle position of the fixing roller pipe 752 than the downstream side (e.g., 754*c*) in the rotation direction adjacent to the upstream portion.

Similarly as shown in FIG. 15, when a recording medium P is held between the fixing roller 750 and pressing roller 70 (FIG. 1) with the lengthwise middle portion of the recording medium P positioned at the middle portion 754*a* of the rib 754 and is delivered in this state in the arrow-F direction, the portions (e.g., 754*b*, 754*c*) of a higher nip pressure is moved along the surface of the recording medium P from the lengthwise middle portion toward the lengthwise end portions of the fixing roller 750. Further the fixing roller pipe 752 is an inversed crown shape. Therefore, the recording medium P is pulled at one side of the lengthwise middle portion in the arrow-G1 direction and at the other side in the arrow-G2 direction during delivery in the arrow-F direction. Consequently, the recording medium is less liable to be fed obliquely, and is delivered with stretching not to cause wrinkling.

A ninth embodiment of the fixing roller is explained below by reference to FIG. 17.

Figure 17:
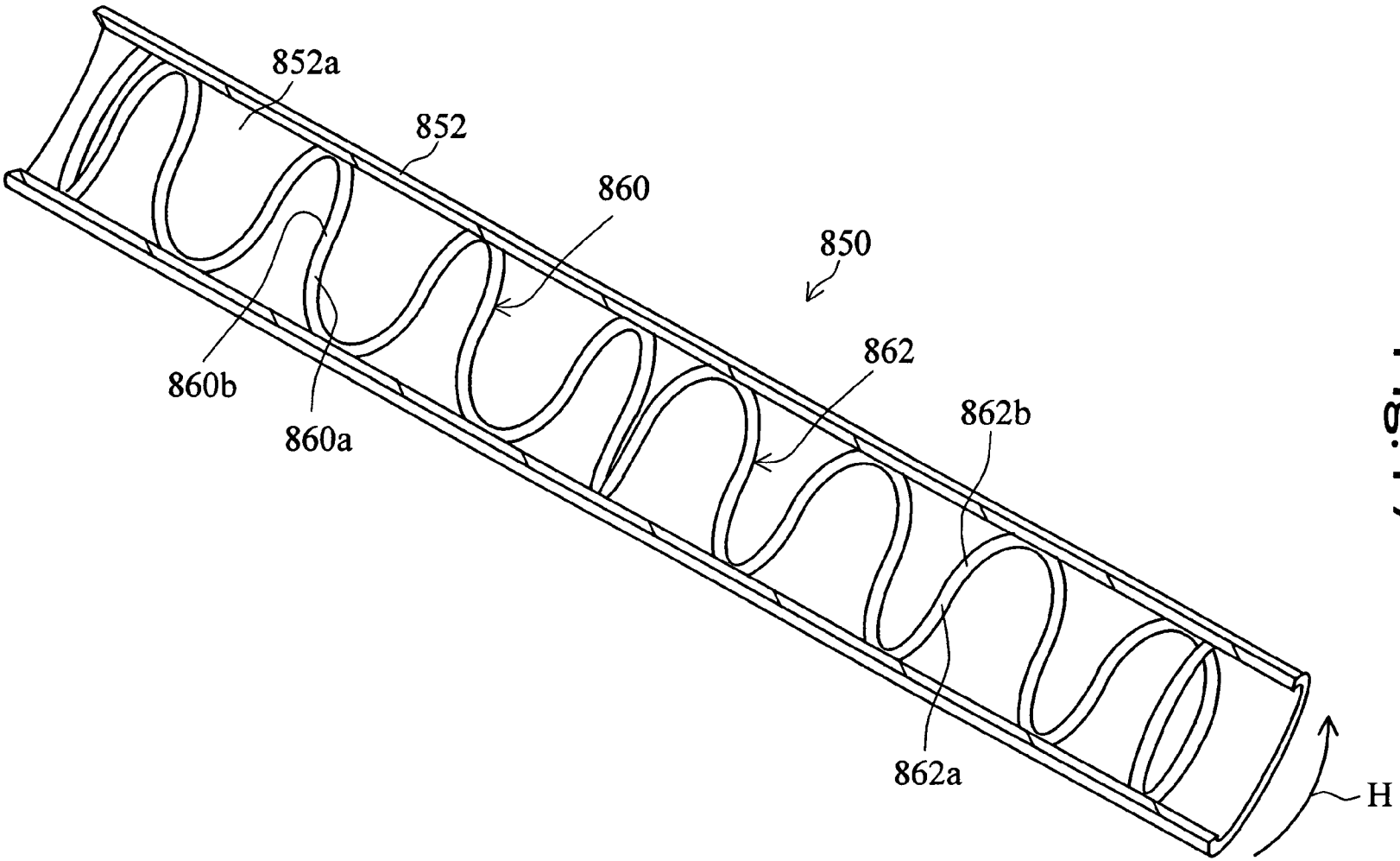
FIG. 17 is a perspective view illustrating the inside of a ninth embodiment of the fixing roller cut in the lengthwise direction.

FIG. 17 is a perspective view illustrating the inside of the eighth embodiment of the fixing roller out in the lengthwise direction.

The fixing roller 850 is provided with a fixing roller pipe 852 (an example of the cylindrical roller of the present invention) constituted of an aluminum-magnesium alloy in a pipe shape (in a hollow cylinder shape). The fixing roller pipe 852 is manufactured by machining to have a wall thickness in the range of 0.28-0.32 mm over the entire range. The outside peripheral face of the fixing roller pipe 852 is covered with a releasing layer (not shown in the drawing). The releasing layer is formed from a material exhibiting high releasability such as a fluoro-resin, an oil-impregnated silicone rubber, and a silicone rubber layer coated with a fluoro-resin on the surface.

Two coil springs 860,862 (an example of two coiled wires of the present invention) coiled in a screw shape are placed in the empty room (inside of fixing roller 850) of the fixing roller pipe 652. The wires are formed from stainless steel. Each of the coil springs 860,862 has an equal length of about half of the fixing roller pipe 852. Thereby the ends of the two coil springs 860,862 are brought into contact with each other at the lengthwise middle portion of the fixing roller pipe 852.

The outside diameters of the coil springs 860,862 are made to be larger by about 0.1-0.5 mm than the inside diameter of the fixing roller pipe 852. Thereby the coil springs 860,862 come into contact with the inside wall face 852*a* (an example of the inside peripheral face in the present invention) surrounding the empty room in the fixing roller pipe 852, pushing (pressing) the inside wall face 852*a* outward. The coil springs 860,862 are fastened to the fixing roller pipe 852 to rotate together with the fixing roller 852.

In manufacturing the aforementioned fixing roller pipe 850, two coil springs 860,862 are prepared which have respectively a coil outside diameter larger by about 0.1-0.5 mm than the inside diameter of the fixing roller pipe 852; firstly one of the coil springs 860 is twisted at the both lengthwise ends thereof in the direction to decrease the outside diameter (in the direction to tighten the winding force); the coil spring in this twisted state is inserted from a first lengthwise end of the fixing roller pipe 852 into the empty room; and the twist of the inserted coil spring 860 is released; then the other coil spring 862 is twisted at the both lengthwise ends thereof in the direction to decrease the outside diameter; the coil spring 862 in this twisted state is inserted from a second lengthwise end of the fixing roller pipe 852 into the empty room; and the twist of the inserted coil spring 862 is released. Thus, the coil springs 860,862 come into contact with the inside wall face 852*a* to push the inside wall face 852*a* outward. Thereby the fixing roller pipe 852 is reinforced by the coil springs 860,862 so as not to be deformed by the pressure of the pressing roller 70 (FIG. 1).

The coil springs 860,862 are wound in the empty room in the fixing roller pipe 852, extends in the length direction of the fixing roller pipe 852, and pushes the inside wall face of the fixing roller pipe 852 outward. The coil springs 860,862 are wound in directions reverse to each other. That is, the coil winding direction is reversed at the lengthwise middle portion of the fixing roller pipe 852 (contact portion of the coil springs 860,862).

The coil springs 860,862 are wound spirally such that an upstream portion (e.g., portion 860*a*, 862*a*) of the coil springs 860,862 in the rotation direction of the fixing roller pipe 652 is nearer to the lengthwise middle position of the fixing roller pipe 652 than the downstream side (e.g., 860*b*, 862*b*) in the rotation direction adjacent to the upstream portion. The coil springs 860,862 are rotated in the arrow-H direction with the rotation of the fixing roller pipe 852.

As shown in FIG. 15, when a recording medium P is held between the fixing roller 850 and pressing roller 70 (FIG. 1) with the lengthwise middle portion of the recording medium P positioned at the contact position of the coil springs 860,862 and is delivered in this state in the arrow-F direction, the portions (e.g., 860*a*,862*a*,860*b*,862*b*) of a higher nip pressure are moved along the surface of the recording medium P from the lengthwise middle portion toward the lengthwise end portions of the fixing roller 850. Therefore, the recording medium P is pulled at one side of the lengthwise middle portion in the arrow-G1 direction and at the other side in arrow-G2 direction during delivery in the arrow-F direction. Consequently, the recording medium P is less liable to be fed obliquely, and is delivered with stretching not to be wrinkled.

In the above examples, the fixing roller pipes 652,752,852 are formed from an alloy of aluminum and magnesium as the material. However, the fixing roller pipe may be formed from either of the metal, or steel, or a composite of the metal with an inorganic material or an organic material. The material of the coil spring 660,860,862 is not limited to stainless steel. The thickness of the fixing roller pipe 652, 752,852 is not limited to the aforementioned one. The winding number of the coil spring 660,860,862 is not limited to the aforementioned number.

A tenth embodiment of the fixing roller is described by reference to FIGS. 18 and 19.

Figure 18:
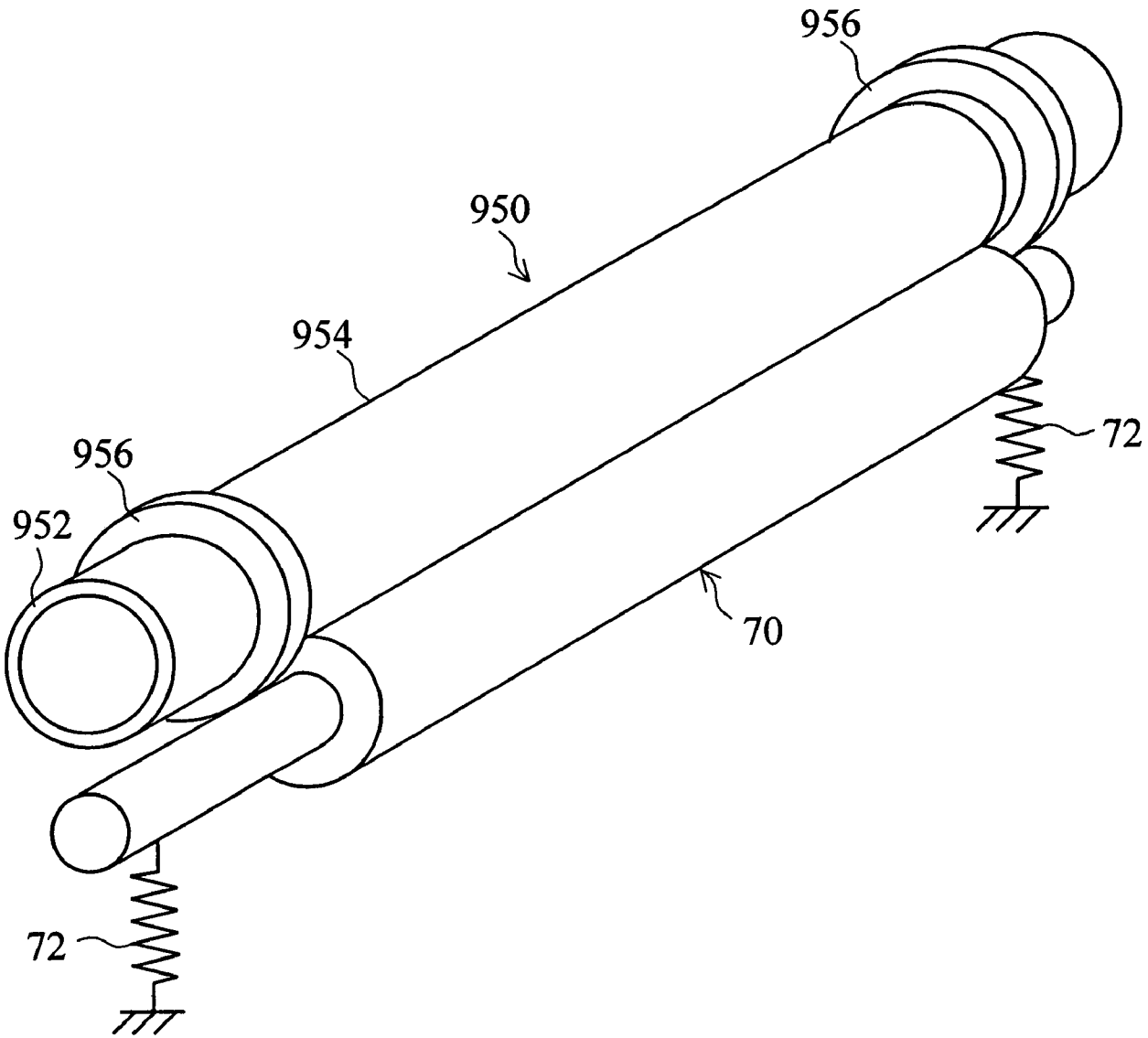
FIG. 18 is a perspective view of a tenth embodiment of the fixing roller.
Figure 19:
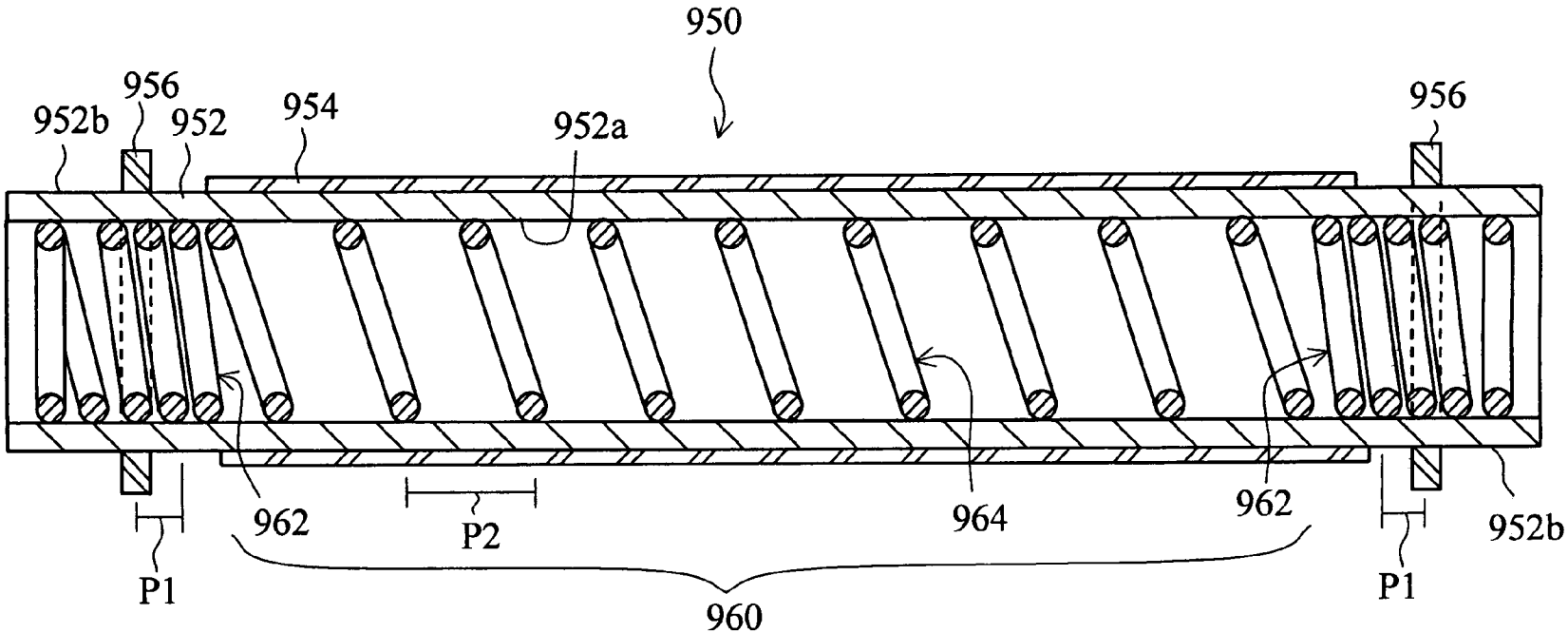
FIG. 19 is a schematic diagram illustrating the inside of the fixing roller of FIG. 18.

FIG. 18 is a perspective view of a tenth embodiment of the fixing roller. FIG. 19 is a schematic diagram illustrating the inside of the fixing roller.

A fixing roller 950 has a base metal pipe 952 (an empty cylinder, an example of a cylindrical roller in the present invention) composed of a metal alloy of aluminum and magnesium. The outside diameter at the lengthwise middle portion is smaller than that of the both lengthwise end portions, thereby the base metal pipe 952 being in a shape of an inverse crown shape. Owing to this inverse crown shape of the base pipe 952, the nipping force (force of pressing a recording medium) at the nip portion between the fixing roller 950 and pressing roller 70 (FIG. 1) is stronger at the both lengthwise end portions than at the lengthwise middle portion. This prevents twisting or wrinkling of the recording medium which is nipped and delivered between by the fixing roller 950 and the pressing roller 70. The outside diameter at the both lengthwise end portions of the base pipe 952 is made larger by about 0.07-0.13 mm than that at the lengthwise middle portion.

The base pipe 952 is machined to have a thickness of about 0.3-0.4 mm throughout the entire pipe material. A releasing layer 954 is provided on the outside peripheral face of the base metal pipe 952. This releasing layer 954 is formed from a material having high releasability such a fluoro-resin, an oil-impregnated silicone rubber, and a silicone rubber layer, and coated with a fluoro-resin layer on the surface. The fixing roller 950 has bearings 956 for supporting rotatably the both lengthwise end portions of the base pipe member 952 in contact with the outside wall face 952*b* of the base pipe member 952. The bearings 956 are placed at the positions outside the recording medium path (region through which a recording medium is delivered, or outside the paper sheet delivery region). As described above, the pressing roller 70 is pushed at the lengthwise end portions thereof against the fixing roller 950 to form a nip portion. Thereby the nip portion is formed by pressing of the pressing roller 70 against the fixing roller 950 (a portion holding the recording medium by contact of rollers 950,70).

A coil spring 960 wound in a coil (an example of the coiled wire of the present invention) is placed in the empty room of the base pipe member 952 (inside space of the fixing roller 950). The coil spring 960 has an outside diameter larger by about 0.1-0.5 mm than the inside diameter of the base pipe member 952. Thereby, the coil spring 960 comes into contact with the inside wall face 952*a* (an example of the inside peripheral face of the present invention) of the empty room of base pipe member 952, and pushes (presses) the inside wall face 952*a* outward. The coil spring 960 is fixed to the base pipe member 952 by the pressing force) and rotates together with the base pipe member 952.

The coil pitch P1 of the coil spring 960 at the portions of the outside wall face 952*b* (an example of the outside peripheral face of the present invention) corresponding to the position of the bearing 956 is made shorter than the coil pitch P2 of the coil spring 960 at the portion of the outside wall face 952*b* than in other portion of the outside wall face 952*b*. In other words, the coil pitch P1 of the coil spring 960 at the both lengthwise ends portions 962,962 is shorter than the coil pitch P2 at the lengthwise middle portion 964 of the coil spring 960. As the result, the both lengthwise ends of the outside wall face 952 is pushed outward by the coil spring 960 stronger than the lengthwise middle portion.

Figure 29:
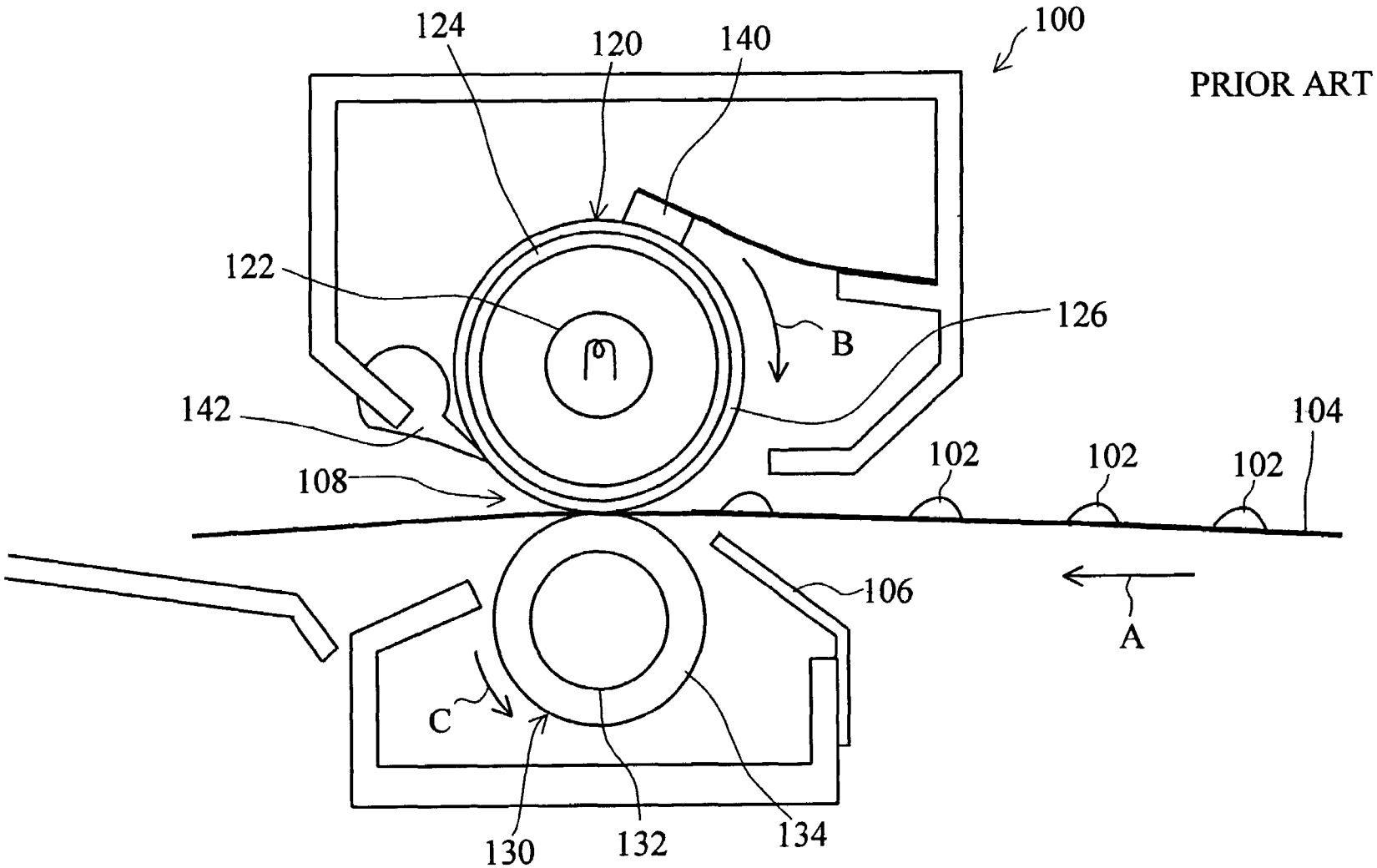
FIG. 29 is a schematic view of a conventional fixation assembly.

The pressing roller 70 is pushed strongly against the fixing roller 950, whereby the base metal pipe 952 is pushed strongly against the bearing 956. However, the coil spring 960 at the lengthwise end portions 962,962 strengthen sufficiently the both lengthwise end portions of the base metal pipe 952 to prevent deformation of the lengthwise end portions of the base metal pipe 952. Therefore, the coil pitch P1 is adjusted to be capable of preventing deformation of the both lengthwise end portions of the base metal pipe caused by the bearing 956. With a shorter pitch P2 of the coil spring 960 at the lengthwise middle portion 964, the heating of the base metal pipe by a halogen heater 122 (FIG. 29) is liable to be insufficient. Therefore the pitch P2 has a lower limit.

Even in the case where the pressing roller 70 is pushed strongly against the fixing roller 950 to rotate faster the fixing roller 950 and the pressing roller 70 for a higher speed of image formation, the aforementioned shorter pitch P1 of the coil spring 960 at the both lengthwise end portions 962,962 prevents deformation of the base metal pipe 952 at the both lengthwise end portions of the base metal pipe 952.

In manufacturing the aforementioned fixing roller pipe 950, a coil spring 960 is prepared which has a coil outside diameter larger by about 0.1-0.5 mm than the inside diameter of the fixing roller pipe 952; the coil spring 960 is twisted at the both lengthwise ends in the direction to decrease the outside diameter (in the direction to tighten the winding force); the coil spring in this twisted state is inserted into the empty room of the fixing roller pipe 952; and the twist of the coil spring 960 is released. Thus, the coil spring 960 comes into contact with the inside wall face 952*a* to push the inside wall face 952*a* outward.

An embodiment of the image-forming apparatus of the present invention is explained by reference to FIG. 20.

Figure 20:
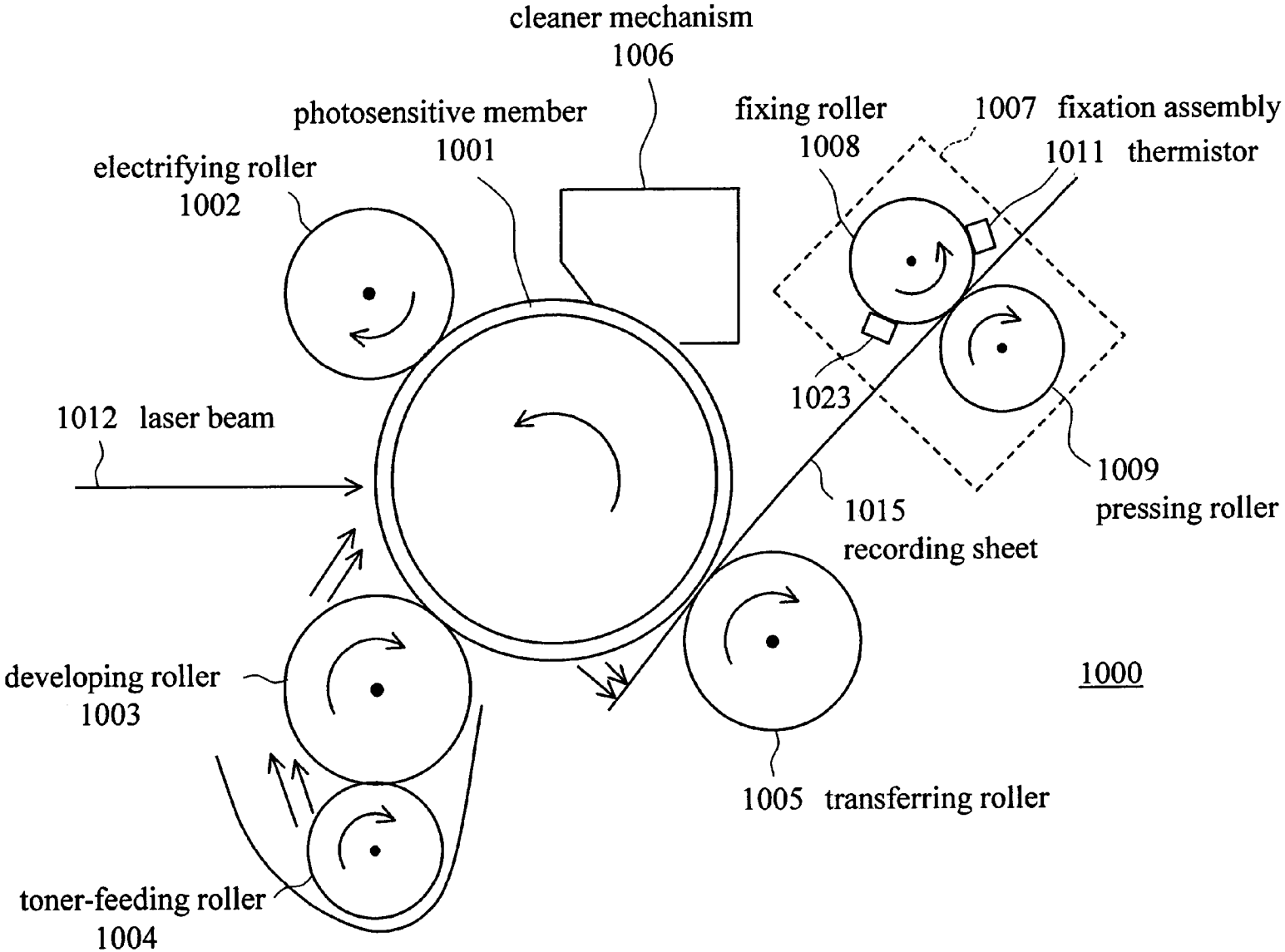
FIG. 20 shows schematically a constitution of an electrophotographic image-forming apparatus equipped with the fixation assembly of the present invention.

FIG. 20 shows schematically a constitution of an electrophotographic image-forming apparatus 1000 equipped with the fixation assembly of the present invention. As shown in FIG. 20, the image-forming apparatus 1000 comprises a photosensitive member 1001 for forming a latent image of a printing object by scanning with a laser beam 1012, an electrifying roller 1002 for electrifying the photosensitive member 1001, a developing roller 1003 applying a toner as a developing agent onto the latent image on the photosensitive member 1001, a feeding roller 1004 for feeding the toner to the developing roller 1003, a transfer roller 1005 for transferring the toner adhering to the photosensitive member 1001 to a recording paper sheet 1015, a cleaner mechanism 1006 for removal of a toner remaining on the photosensitive member 1001, and a fixation assembly 1007 for fixing the toner adhering onto the recording paper sheet 1015.

Figure 21:
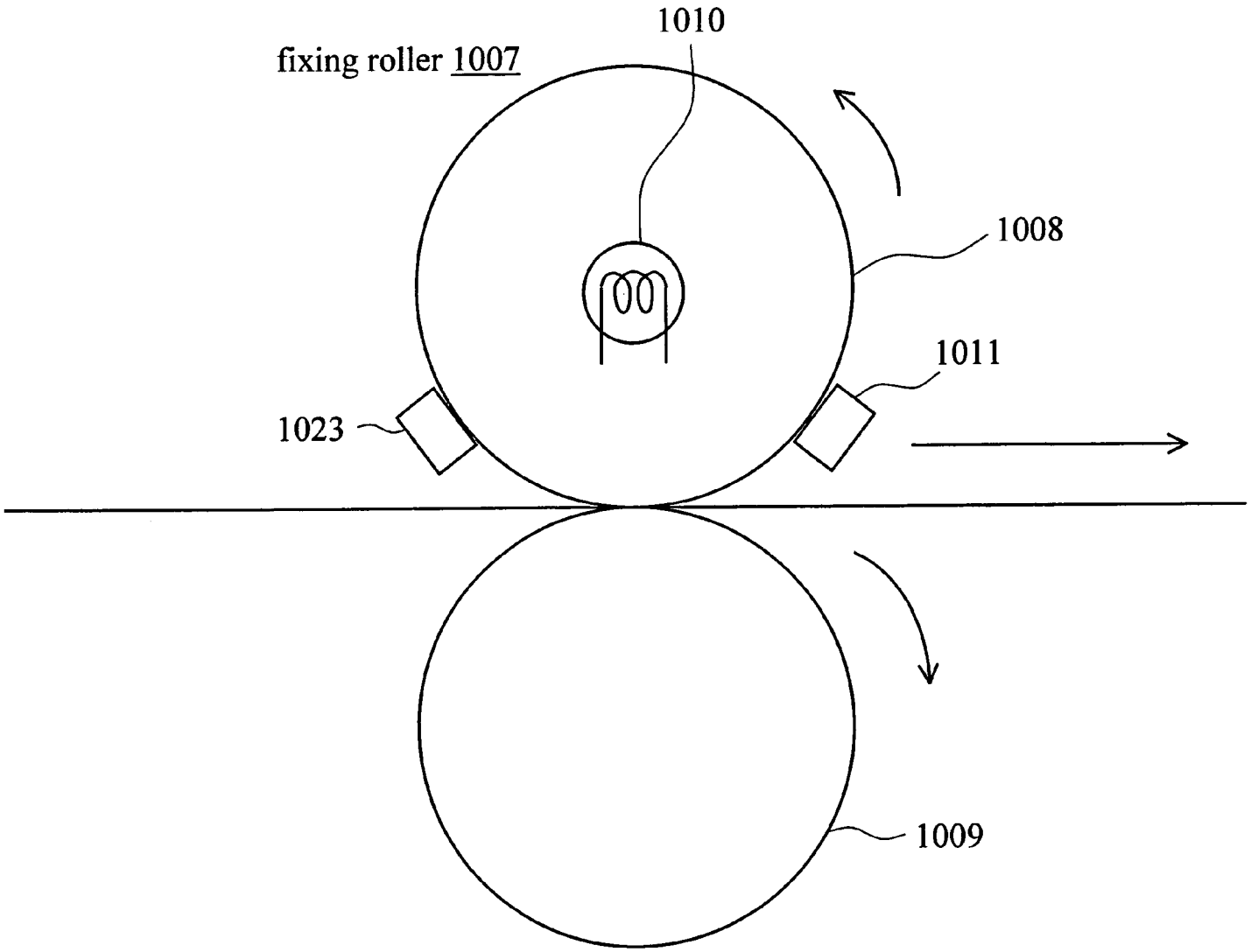
FIG. 21 is a schematic side view of a fixation assembly of the present invention.

FIG. 21 is a schematic side view of a fixation assembly 1007 of the present invention. As shown in FIG. 21, the fixation assembly 1007 comprises a fixing roller 1008 for heating a recording paper sheet, and a pressing roller 1009 for pressing the recording paper sheet against the fixing roller 1008. A thermistor 1011 (a first thermistor or main thermistor) is provided on a side face of the fixing roller 1008 on the downstream side (sheet discharge side) in the sheet delivery direction for control of the fixing roller 1010, and another thermistor 1023 (a second thermistor or a sub-thermistor) is provided on the upstream side (sheet feed side) in the sheet delivery direction for detection of abnormal temperature. The both thermistors are preferably in contact with the surface of the fixing roller 1008. This fixing roller 1008 is provided with a halogen lamp 1010 in the empty room of the fixing roller 1008 for conducting heat treatment. In prior art techniques, as described above, a temperature sensor is placed on the upstream side of the contact portion of the fixing roller 1008 with the pressing roller 1009, which makes insufficient the time after detection of drop of the temperature of the fixing roller 1008 caused by the recording paper sheet before the next contact with the pressing roller 1009. This makes insufficient the time for recovery of the lowered temperature of the fixing roller 1008, and decreases the fixability on the recording paper sheet on the second rotation of the fixing roller 1008 disadvantageously. On the other hand, in the present invention, the temperature sensor is placed on the downstream side of the contact portion of the fixing roller 1008 with the pressing roller 1009. This makes the time sufficient from detection of lowered temperature of the fixing roller 1008 by the recording paper sheer to next contact with the pressing roller 1009. Thus, the toner fixing can be conducted stably without the problem of the prior art techniques, owing to the sufficient time for recovery of the temperature at the lowered temperature portion of the fixing roller 1008.

Figure 22:
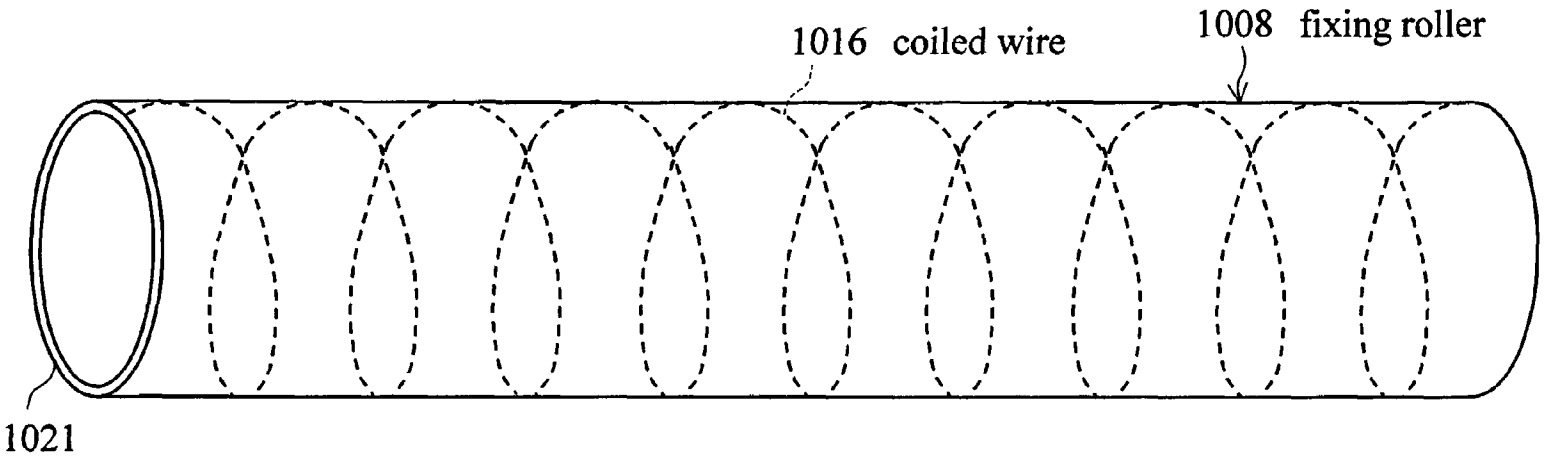
FIG. 22 is a drawing for explaining the structure of the fixing roller of the fixation assembly of the present invention.

In the heat roller 1008 of this embodiment, as shown in FIG. 22, the rigidity of the roller is increased by providing a coiled metal wire 1016 shaped in a spiral as a reinforcing member provided on the inside peripheral face of the thin-walled cylindrical heat roller 1021. In place of the metal wire, ribs may be provided on the inside peripheral face of the thin-walled cylindrical heat roller 1021.

Figure 23:
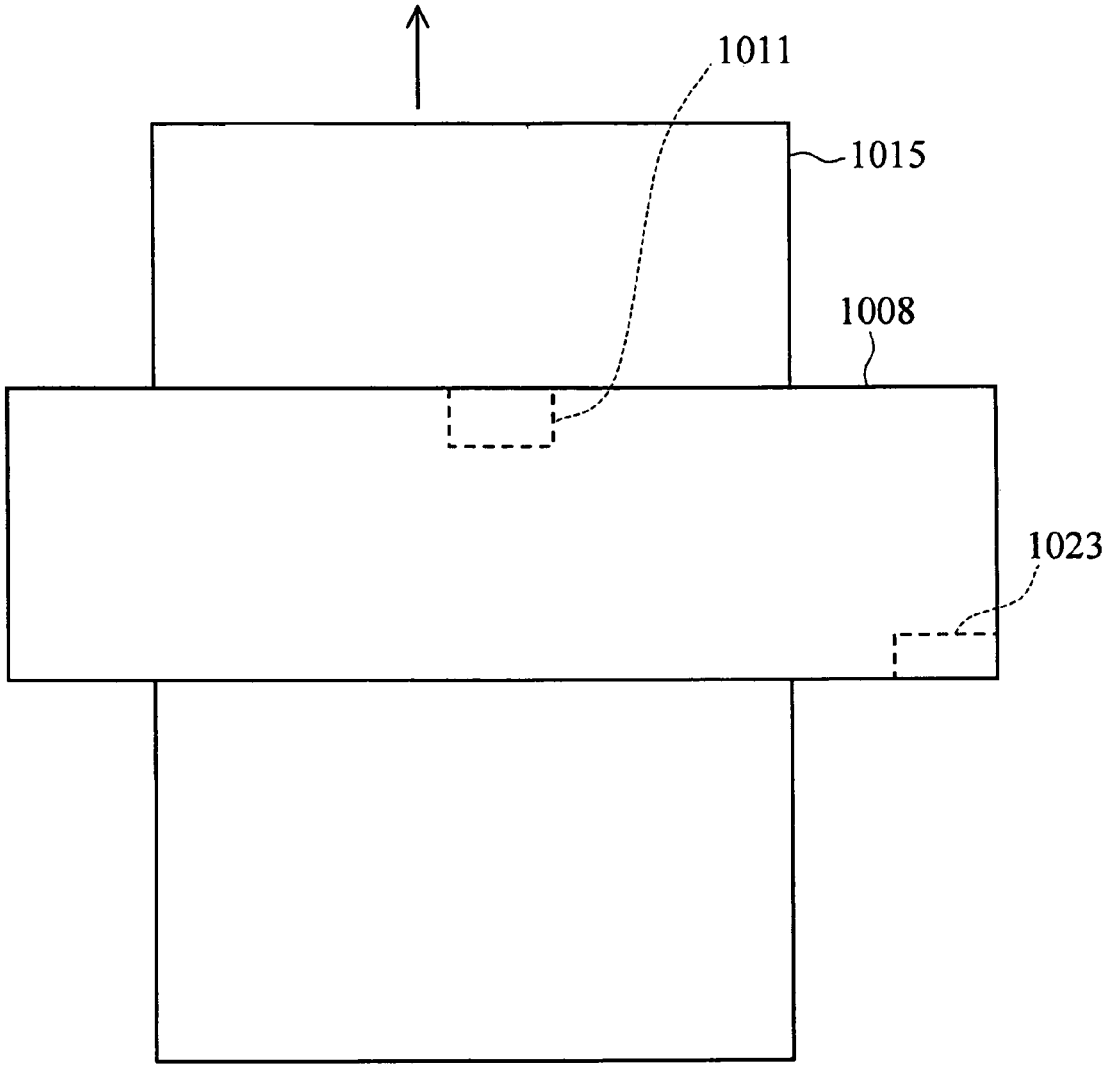
FIG. 23 is a schematic plan view of an embodiment of the fixing roller of the fixation assembly of the present invention taken from the top side.
Figure 24:
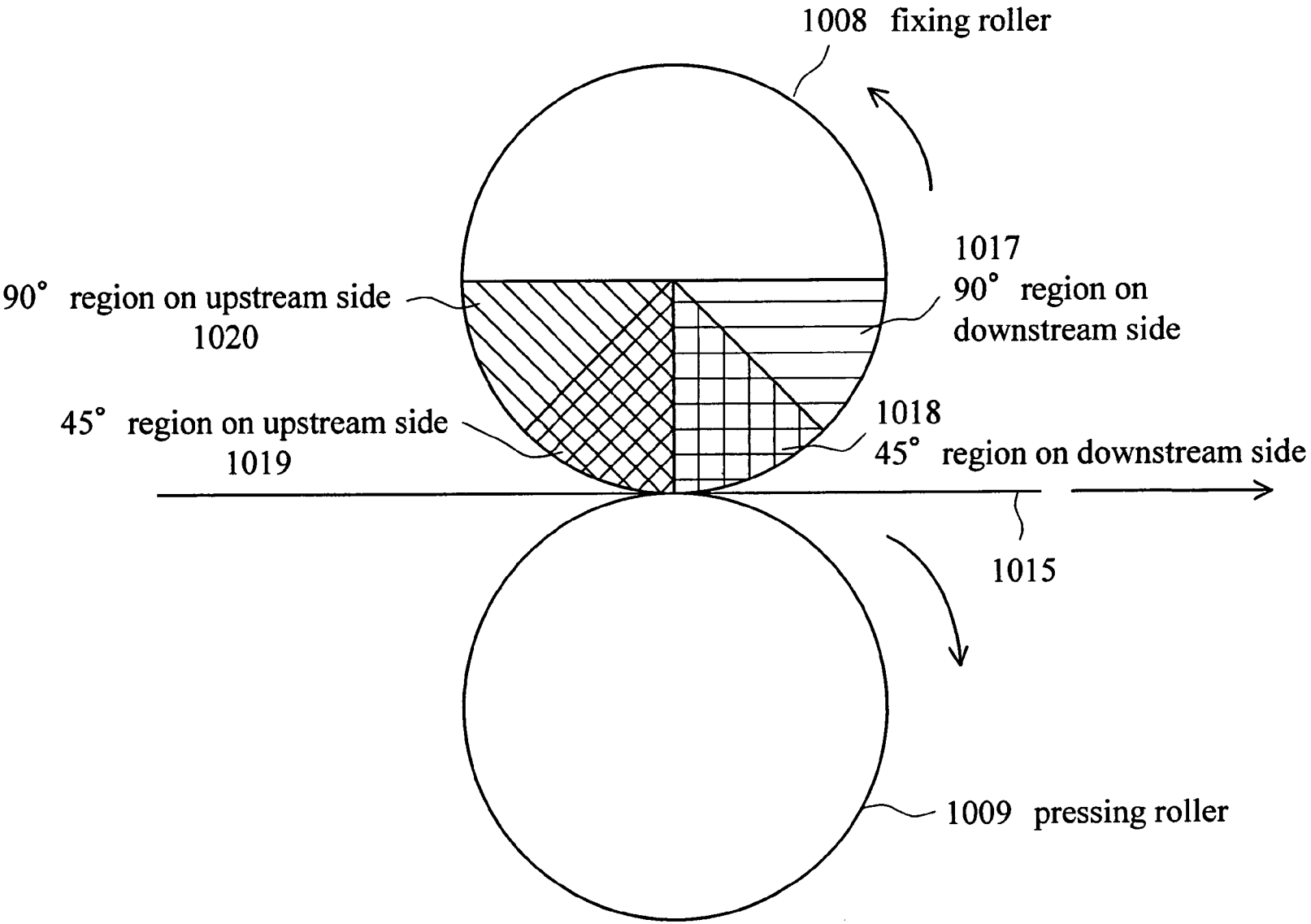
FIG. 24 is a drawing for explaining the set position of a thermistor on the upstream side and down stream side in the embodiments of the present invention.

FIG. 23 is a schematic plan view of the fixing roller 1008 taken from the top side. A shown in FIG. 23, the thermistor 1011 is placed on the downstream side on the lengthwise middle portion of the fixing roller 1008. On the other hand, the thermistor 1023 is placed at the upstream side (recording paper sheet feed side) on the lengthwise end portion. This position of the thermistor is in the vicinity (e.g., ±10 mm) to the lengthwise end of the maximum size of the recording paper sheet, preferably outside the side edge of the maximum size of recording medium. The thermistor 1023 is different in use from the thermistor 1011. The thermistor 1023 is used not for temperature control of the fixing roller 1008, but for preventing abnormal heating for safety. That is, the thermistor 1023 detects abnormal temperature rise of the fixing roller 1008. As shown in FIG. 24, the "downstream side" for the thermistor set position is in the region 1017 ranging from the nip portion between the fixing roller 1008 and the pressing roller 1009 to a peripheral portion of the roller at a roller central angle of 90° in the sheet delivery direction (corresponding to sheet discharge direction), preferably in the region 1018 at a roller central angle of 45° or smaller. Here, the above-mentioned angle means, in FIG. 24, an angle measured counterclockwise from the nip of the two rollers. The "upstream side" for the thermistor set position is in the region 1020 from the nip portion between the two rollers to a peripheral portion of the roller at a roller central angle of 90° in the upstream side in the sheet delivery direction (corresponding to sheet feed direction), preferably in the region 1019 at the roller central angle of 45° or smaller. Here, the above-mentioned angle means, in FIG. 24, an angle measured clockwise from the nip of the two rollers. The set position of the thermistor 1011 is selected in view of detection of a lower temperature, and the set position of thermistor 1023 is selected in view of detection of a higher temperature.

Figure 25:
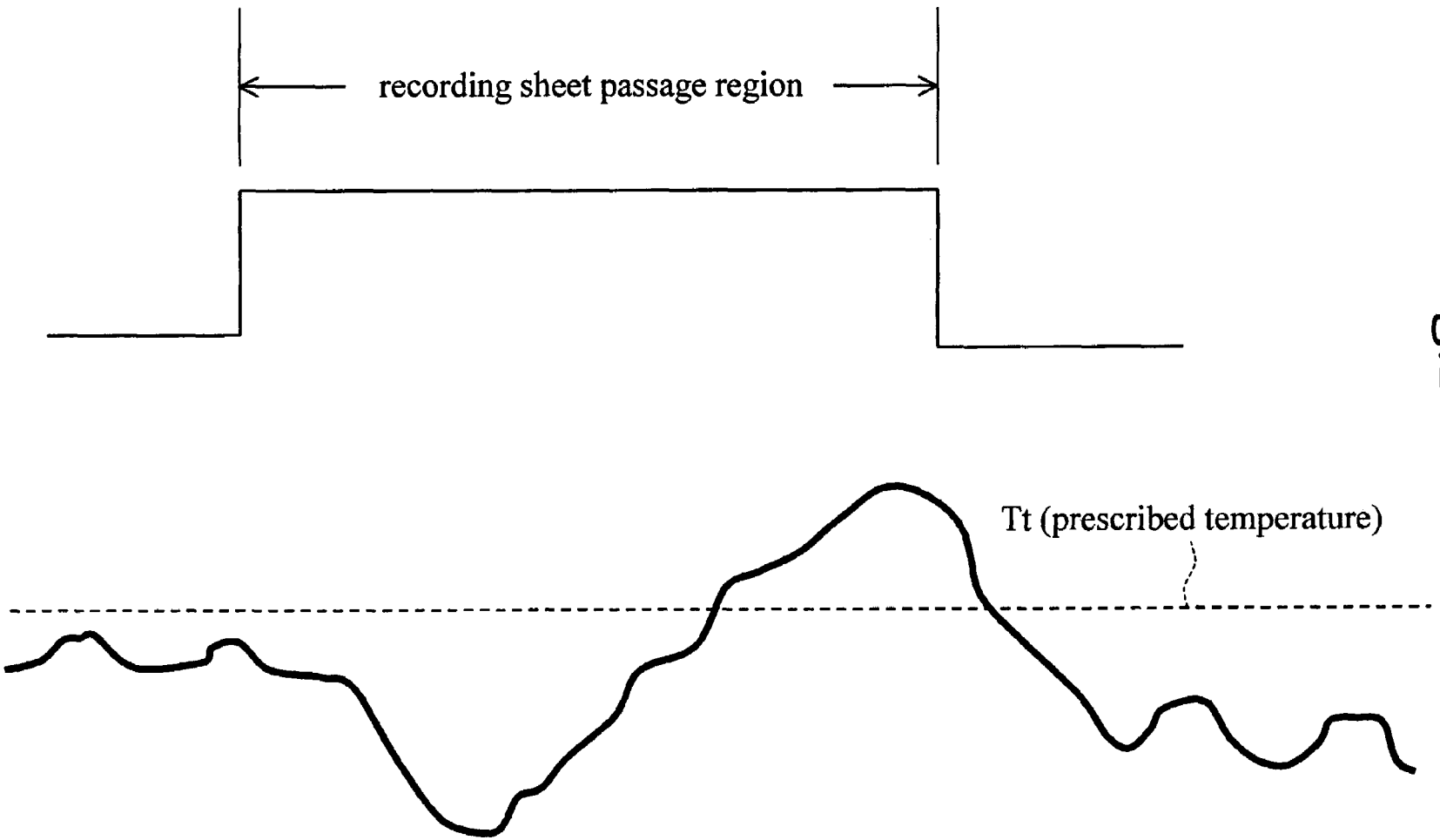
FIG. 25 is a graph showing change of a detected temperature in a conventional fixing roller.

FIG. 25 is a graph showing detected temperature change of a conventional fixing roller. The abscissa in this graph shows the time, and the ordinate shows the temperature. In the sheet path range, the temperature of the fixing roller becomes lower than the prescribed temperature. With the main thermistor 1002 at the sheet feed side, the detection of the drop of the temperature is delayed, failing quick temperature control, which causes temperature decrease in the region requiring the heat to cause instable fixing temperature, resulting in decrease of fixability.

Figure 26:
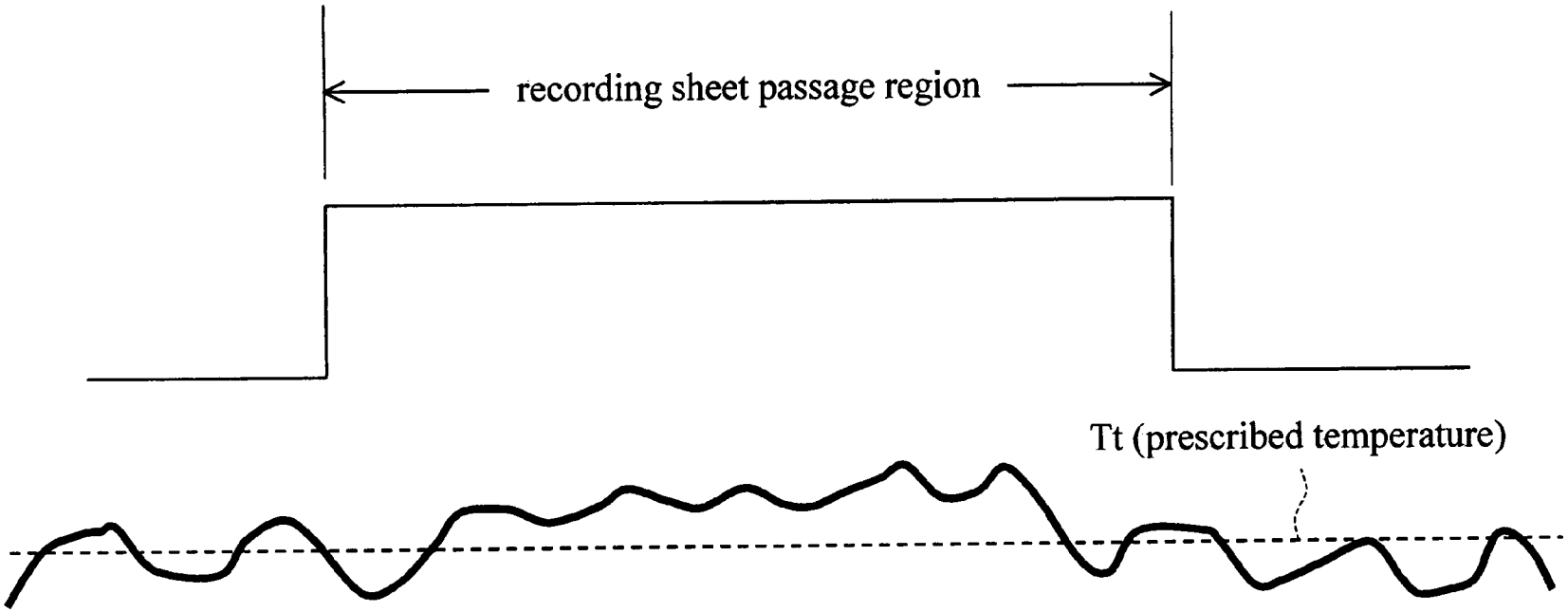
FIG. 26 is a graph showing change of a detected temperature in an embodiment of the present invention.

In contrast, in this embodiment the present invention, as shown in the graph of FIG. 26, the temperature of the fixing roller is detected earlier to stabilize the adjustment of the temperature to decrease the temperature variation. Thus, the detection response is quicker to prevent significant drop of the temperature of the fixing roller from the intended temperature.

Figure 27:
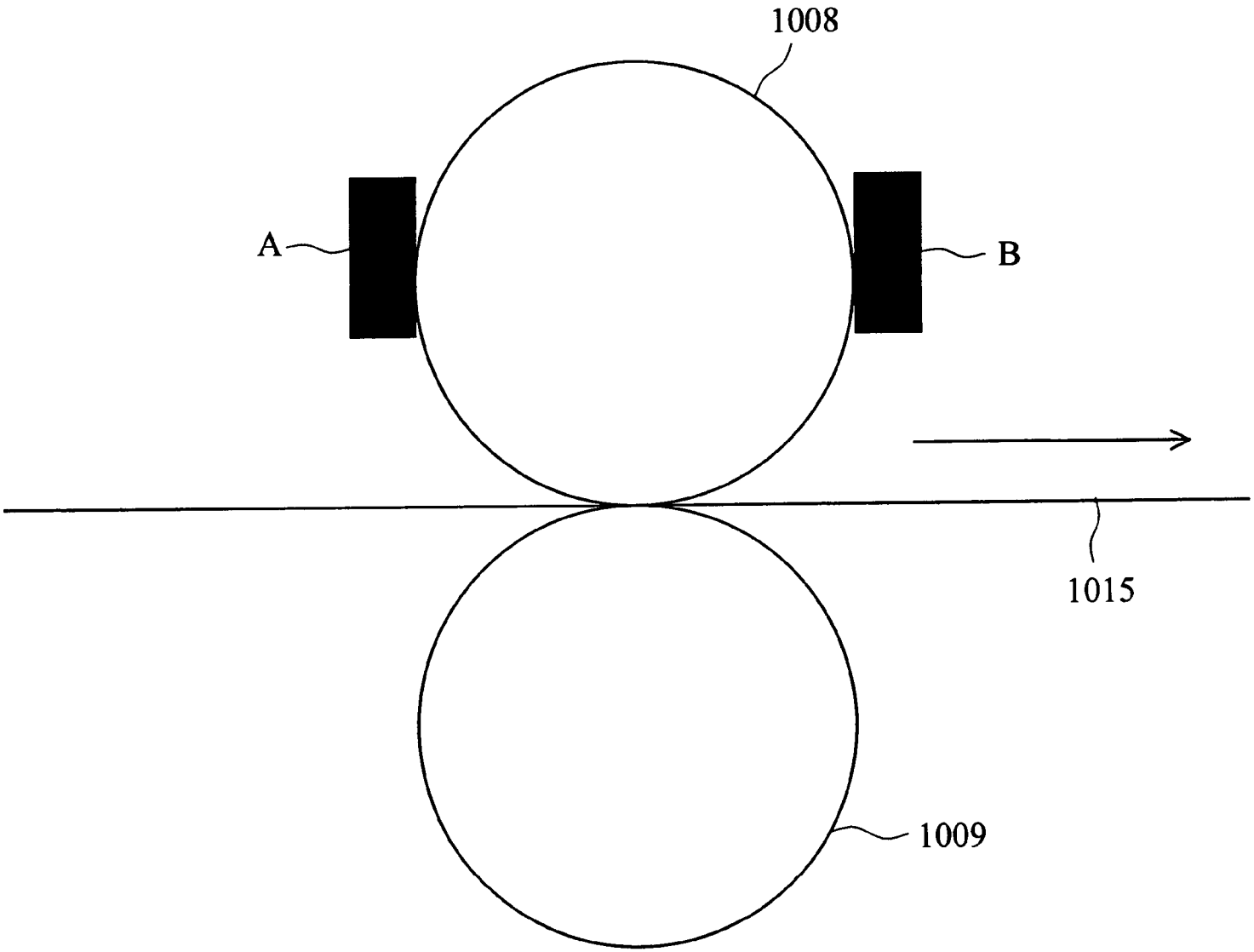
FIG. 27 is a drawing for explaining the set position of the second thermistor in the embodiments of the present invention.
Figure 28:
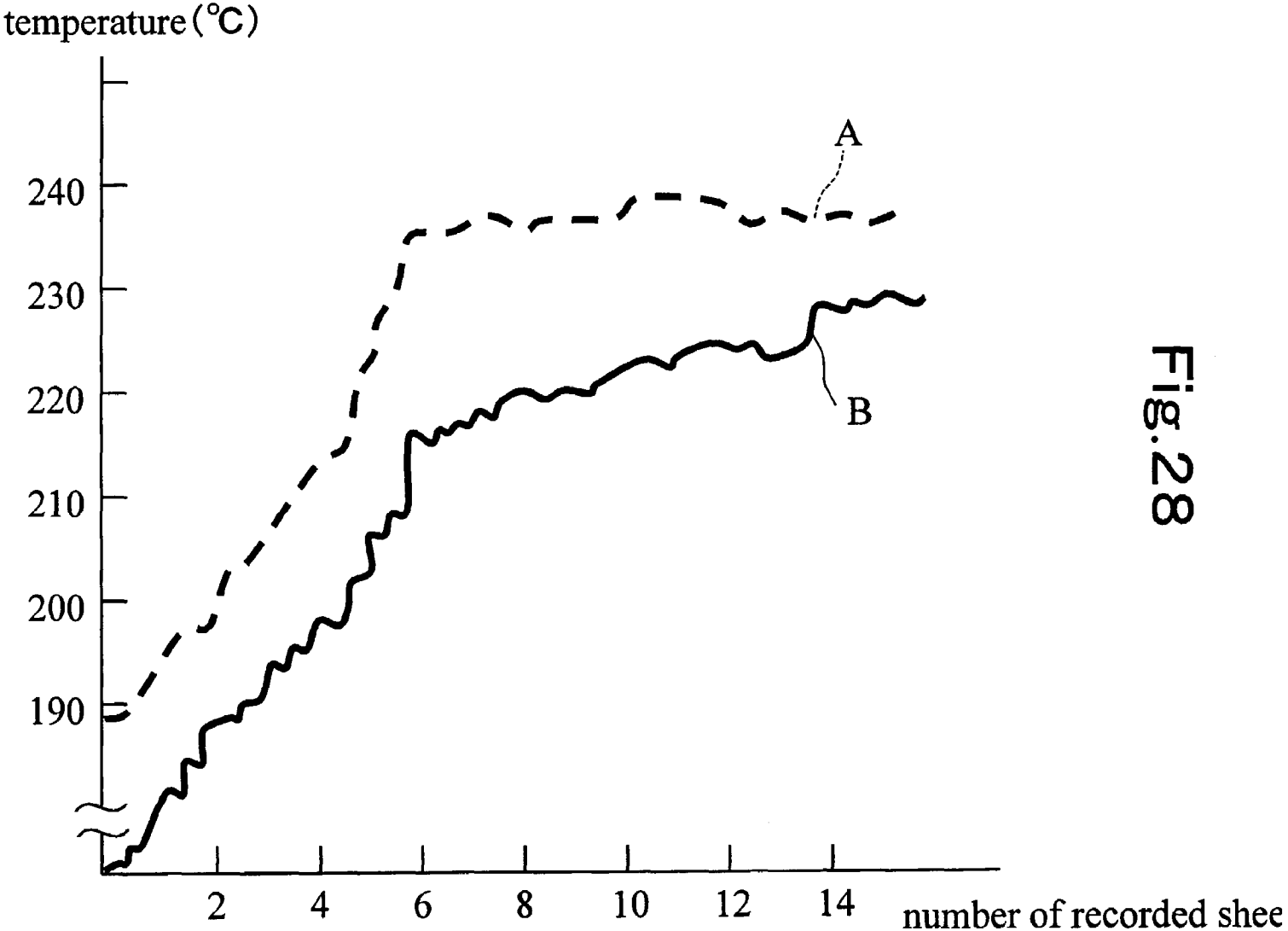
FIG. 28 is a graph showing change of the temperatures detected by the second thermistor at position A and B indicated in FIG. 27 as a function of number of continuously recorded sheets.

The set position of the thermistor 1023 is explained by reference to FIG. 27. FIG. 27 shows possible positions A and B of the thermistor 1023. When printing is conducted continuously with recording paper sheets of a smaller size, the temperature can rise at the fixing roller ends by the sheet passage. FIG. 28 shows this temperature change. The abscissa shows the number of sheets used for continuous recording, and the ordinate shows a temperature detected by thermistor 1023. As shown in FIG. 28, the temperature detected at the position A is different from the temperature detected in the position B. Specifically, the temperature at the detection position A (sheet feed side) is higher than that at the detection position B. Therefore, the abnormal temperature rise can be quickly detected by setting the thermistor 1023 at the detection position A where the detected temperature is higher.

As described before, the fixing roller is reinforced by a coil spring or the like. Therefore, the deformation of the fixing roller and the like is prevented to show stable fixation performance, even with decreased thickness of the fixing roller or the like for shortening the warming-up time.

Preferred embodiments of the present invention are described above. However, the embodiments can be changed or modified within the claimed range of the invention.

INDUSTRIAL APPLICABILITY

As described above, in a first fixing roller of the present invention, the inside wall face and the reinforcing member are connected electrically since the contact portion is not coated with the black film even if the black film is electrically insulating. Therefore, the inside wall of the fixing roller and the reinforcing member are kept at the same potential, causing no electric discharge therebetween to give no electric noise. On the other hand, the non-contact area is coated with the black film for efficient absorption of heat from the heater. Therefore, the fixing roller can be heated up quickly in a shorter warming-up time to the prescribed temperature.

The black film, which is heat-resistant is less deteriorating, will lengthen the life of the fixing roller.

The area other than the contact portion can readily be coated with the black film by applying and baking a black paint onto the reinforcing member and the non-contact area.

The reinforcing member, which has a disk-shaped main body and projections provided on the periphery of the main body, can be made simple in the structure.

In the process for manufacturing the fixing roller of the present invention, the inside wall face and the reinforcing member are connected electrically since the contact portion is not coated with the black film even if the black film is electrically insulating. Therefore, the inside wall of the fixing roller and the reinforcing member are kept at the same potential, causing no electric discharge therebetween to give no electric noise. On the other hand, the non-contact area is coated with the black film for efficient absorption of heat from the heater. Therefore, the fixing roller can be heated up quickly up to the prescribed temperature.

In the manufacturing process, the non-contact area excluding the contact portion can readily be coated with the black film by inserting the reinforcing member in the empty room, applying and baking a black paint onto the reinforcing member and the non-contact area.

In the fixation assembly of the present invention, the fixing roller can be heated up quickly to warm up the fixation assembly. Thereby the fixation assembly is suitable for energy saving.

In a second fixing roller of the present invention, the driving force for rotation in the direction for enlarging the coiling diameter is transmitted to the coiled wire which is fastened at the other end (a second end) to the gear. The one end (a first end) of the coiled wire is fastened to one lengthwise end of the cylindrical roller and the driving force transmitted to the coiled wire is distributed over the entire coiled wire to enlarge the winding diameter thereof, and the coiled wire pushes outward the inside face of the cylindrical roller. Thereby, the driving force transmitted to the coiled wire is distributed over the entire of the cylindrical roller to rotate the cylindrical roller. Since the driving force transmitted from the gear is dispersed without concentration to a limited portion of the cylindrical roller, the cylindrical roller will be rotated without damage even if the cylindrical roller has a thin wall. Moreover, the cylindrical roller is reinforced by the coiled wire pushing the inside peripheral wall of the cylindrical roller.

The coiled wire, when it is engaged detachably to a hole formed at a one lengthwise end (a first end) of the cylindrical roller, can readily be fastened by inserting the coiled wire into the cylindrical roller. The coiled wire can be exchanged readily.

The gear serves to transmit the driving force directly to the other lengthwise end (a second end) of the cylindrical roller. When the directly transmitted driving force is weaker than the driving force directly transmitted to the coiled wire at the second end, the driving force of the gear is directly transmitted to the second lengthwise end of the cylindrical roller and the driving force of the gear is transmitted in a more dispersed manner.

When the cylindrical roller has a depression at the second lengthwise end and the gear has a projection to be fit to the depression, the driving force of the gear is transmitted readily and directly to the second lengthwise end of the cylindrical roller.

The coiled wire, which pulls the gear toward the first lengthwise end of the cylindrical roller, prevents also drop-off of the gear from the cylindrical roller.

In a third embodiment of the fixing roller of the present invention, the coiled wire pulls the gear toward a second lengthwise end of the cylindrical roller to prevent drop-off of the gear from the cylindrical roller. Moreover, the coiled wire pushes outward the inside peripheral face of the cylindrical roller to reinforce the cylindrical roller to increase the strength.

A structure for preventing drop-off of the gear from the cylindrical roller can be simply constructed by forming a depression in the second length end portion of the cylindrical roller; forming a projection on the gear for fitting to the depression and a hole for inserting the end of the coiled wire; and by fastening the coiled wire by inserting the end thereof into the hole of the gear so as to pull the gear toward the first lengthwise end of the cylindrical roller.

In a fourth embodiment of the fixing roller of the present invention, the cylindrical roller is reinforced from the inside by pressing (pushing) a spiral coiled wire against the inside peripheral face. Therefore, the cylindrical roller is less liable to be deformed by an external force applied the outside peripheral face of the cylindrical roller. The outside peripheral face is pushed locally outward more strongly at the portion where the coiled wire is brought into contact with the inside peripheral face. Therefore, in delivery of a recording medium by holding it between the cylindrical roller and another roller, the point of the higher pressure (nip pressure) is moved with rotation of the cylindrical roller. In the embodiment in which the winding direction of the coiled wire is reversed at a certain position in the lengthwise direction in the cylindrical roller, the recording medium is fed correctly without oblique delivery of the recording medium.

The coiled wire, which is wound in winding directions reversed at the lengthwise middle of the cylindrical roller, prevents entirely oblique delivery of the recording medium owing to the reversed winding directions.

The coiled wire may be wound spirally such that an upstream portion of the coiled wire in the rotation direction of the cylindrical roller is nearer to the lengthwise middle position of the cylindrical roller than the downstream portion in the rotation direction adjacent to the upstream portion. In delivery of a recording medium with such a roller in combination with another roller, the portions of a higher holding pressure (nip pressure) are moved with the rotation of the cylindrical roller from the lengthwise middle portion of the cylindrical roller to the lengthwise ends thereof. Thereby, the recording medium is delivered with stretch in the length direction of the cylindrical roller, not causing a wrinkle.

The coiled wire to be in contact with the inside peripheral face of the cylindrical roller to press the inside peripheral face outward may be constituted of plural short fractions of the coiled wire shorter than the length of the cylindrical roller and linked together. Such short coiled wire fractions are adaptable to change of the length of the cylindrical roller.

The coiled wire, which is made of an elastic material, is capable of deforming in response to an external force to lengthen the life of the fixing roller.

In a fifth fixing roller of the present invention, the cylindrical roller is reinforced from the inside by pressing (pushing) a spiral coiled wire against the inside peripheral face. Therefore, the cylindrical roller is less liable to be deformed by an external force applied to the outside peripheral face of the cylindrical roller. The outside peripheral face is pushed locally outward more strongly at the portion of contact of the coiled wire with the inside peripheral face. Therefore, in delivery of a recording medium by holding it between the cylindrical roller and another roller, the points of the higher pressure (nip pressure) are moved with rotation of the cylindrical roller. In this embodiment, the winding direction of the coiled wire is reversed at a prescribed position in the lengthwise direction in the cylindrical roller, so that the recording medium is fed correctly without oblique delivery of the recording medium.

The aforementioned two coiled wire fractions may be wound spirally such that an upstream portion of the coiled wire in the rotation direction of the cylindrical roller is nearer to the lengthwise middle position of the cylindrical roller than the downstream portion in the rotation direction adjacent to the upstream portion. In delivery of a recording medium with such a cylindrical roller in combination with another roller, the portions of a higher holding pressure (nip pressure) are moved with the rotation of the cylindrical roller from the lengthwise middle portion of the cylindrical roller to the lengthwise ends thereof. Thereby, the recording medium is delivered with stretch in the length direction of the cylindrical roller, not causing a wrinkle.

In a sixth fixing roller of the present invention, the cylindrical roller is reinforced from the inside by a spiral rib. Therefore, in delivery of a recording medium by holding it between the cylindrical roller and another roller, the points of the higher pressure (nip pressure) are moved with rotation of the cylindrical roller. In this embodiment, the winding direction of the coiled wire is reversed at a prescribed position in the lengthwise direction in the cylindrical roller, so that the recording medium is fed correctly without oblique delivery of the recording medium.

The rib, which is wound in spiral directions reversed at the lengthwise middle of the cylindrical roller, prevents entirely the oblique delivery of the recording medium owing to the reversed spiral directions.

The aforementioned rib may be spiraled such that an upstream portion of the rib in the rotation direction of the cylindrical roller is nearer to the lengthwise middle position of the cylindrical roller than the downstream portion in the rotation direction adjacent to the upstream portion. In delivery of a recording medium with such a cylindrical roller in combination with another roller, the portions of a higher holding pressure (nip pressure) move with the rotation of the cylindrical roller from the lengthwise middle portion of the cylindrical roller to the lengthwise ends thereof. Thereby, the recording medium is delivered with stretch in the length direction of the cylindrical roller, causing no wrinkle.

In a seventh fixing roller of the present invention, the portions opposing to a bearing of the outside peripheral face of the cylindrical roller are pressed outward at a stronger pressure than other portions, so that the portion of the outside peripheral face opposing to the bearings will not deformed even when the cylindrical roller is pressed against the bearings.

In a eighth fixing roller of the present invention, the coil pitch is shorter at the portions opposing to the bearing of the outside peripheral face than other portions. Therefore, the portions opposing to the bearings are pressed outward by a stronger force than other portions. Therefore, the outside peripheral face will not be deformed even when the cylindrical roller is pushed strongly to the bearings.

In a second fixation assembly of the present invention, a first temperature sensor is placed on the downstream side of the nip between the fixing roller and the pressing roller in the direction of the recording medium delivery. The temperature of the fixation assembly can be controlled in consideration of a temperature drop caused by passage of a recording medium, whereby the temperature control of the fixation assembly can be conducted with high responsiveness and with sure toner fixation. Therefore the toner can be fixed surely regardless of the thickness of the recording medium.

In this fixation assembly, a second sensor is placed on the end portion on the upstream side to enable quick detection of temperature rise at the end portions of the fixing roller caused by thickness decrease of the fixing roller and passage of smaller-size paper sheets.

The surface temperature of the fixing roller is affected by heat absorption by the passed recording medium and the pressing roller. In the second fixation assembly, a certain time can be secured after detection of the temperature of the fixing roller immediately after passage of the recording medium by the temperature sensor before the next contact of the temperature-lowered portion of the fixing roller with the pressing roller. Thereby the lowered temperature can be restored to a necessary temperature to enable stable toner fixation. Consequently the fixation assembly is improved in the temperature control responsiveness to ensure stable toner fixation regardless of the change of thickness of the recording medium.

The invention claimed is:

1. A fixing roller, comprising a cylindrical roller having an empty room;

a coiled wire extending in the empty room of the cylindrical roller in the length direction of the cylindrical roller, being in contact with an internal peripheral face of the cylindrical roller, and fastened at a first end thereof to a first lengthwise end of the cylindrical roller; and a gear fitted to a second lengthwise end of the cylindrical roller and fixed to a second end of the wire; and the gear being rotated in a direction of enlarging the coil diameter of the coiled wire fixed to the gear to press the cylindrical roller outward.

2. The fixing roller according to claim 1, wherein the first end of the coiled wire is inserted into a hole formed at the first lengthwise end of the cylindrical roller to be fastened detachably.

3. A fixation assembly for fixing thermally a developing agent, comprising a fixing roller set forth in claim 1.

4. A fixing roller, comprising a cylindrical roller having an empty room;

a coiled wire extending in the empty room of the cylindrical roller in the length direction of the cylindrical roller, being in contact with an internal peripheral face of the cylindrical roller, and fastened at a first end thereof to a first lengthwise end of the cylindrical roller; and a gear fastened to a second lengthwise end of the cylindrical roller and fixed to a second end of the cylindrical wire; and the cylindrical roller is rotated by driving the gear in a direction of enlarging the coil diameter of the coiled wire, wherein a driving force of the gear is transmitted directly to the second lengthwise end of the cylindrical roller, and the directly transmitted driving force is weaker than the driving force transmitted from the gear directly to the second end of the coiled wire.

5. The fixing roller according to claim 4, wherein a recess is formed at the second lengthwise end thereof, and the gear has a projection to be fit into the recess.

6. The fixing roller according to claim 4, wherein the first end of the coiled wire is inserted into a hole formed at the first lengthwise end of the cylindrical roller to be fastened detachably.

7. The fixing roller according to claim 6, wherein a recess is formed at the second lengthwise end thereof, and the gear has a projection to be fit into the recess.

8. A fixing roller, comprising a cylindrical roller having an empty room;

a coiled wire extending in the empty room in the length direction of the cylindrical roller, being in contact with an internal peripheral face of the cylindrical roller to push the inside peripheral face outward; and a gear fixed to the end of the coiled wire at second lengthwise end of the cylindrical roller so as to be pulled toward the first lengthwise end of the cylindrical roller.

9. The fixing roller according to claim 8, wherein the cylindrical roller has a recess at the second lengthwise end thereof, the gear has a projection to be engaged to the recess, and a hole for inserting the end of the coiled wire, and the coiled wire pulls the gear toward the first lengthwise end of the cylindrical roller by fastening by insertion of the end of the coiled wire into the hole of the gear.

10. A fixation assembly for fixing thermally a developing agent, comprising a fixing roller set forth in claim 8.

11. The fixation assembly according to claim 10, wherein a first temperature sensor is placed at or near a middle of the recording medium path region for use for temperature control of the fixing roller.

12. The fixation assembly according to claim 10, wherein a first temperature sensor is placed at the paper discharge side at the peripheral direction at a roller central angle of not more than 45 degrees relative to a perpendicular line to a fixation nip.

13. The fixation assembly according to claim 10, 11, or 12, wherein the assembly comprising a second temperature sensor placed at an upstream side in the recording medium delivery direction of the nip between the fixing roller and the pressing roller, the second temperature sensor detects abnormal high temperature rise of the fixing roller.

14. An image-forming apparatus comprising a fixing assembly set forth in any of claims 10 to 12.

15. An image-forming apparatus comprising a fixing roller set forth in any of claims 1, 2, 8 and 9.

16. The fixing roller according to any of claims 4, 5, 6, or 7, wherein the coiled wire pulls the gear toward the first lengthwise end of the cylindrical roller.

* * * * *